United States Patent [19]

Dunlap

[11] 4,046,259

[45] Sept. 6, 1977

[54] STACKING METHOD

[75] Inventor: Clifford E. Dunlap, Pasadena, Calif.

[73] Assignee: W. A. Krueger Co., Scottsdale, Ariz.

[21] Appl. No.: 637,525

[22] Filed: Dec. 4, 1975

Related U.S. Application Data

[62] Division of Ser. No. 457,367, April 2, 1974, abandoned.

[51] Int. Cl.[2] ..... B65H 33/14; B07C 5/342

[52] U.S. Cl. ..... 209/111.7 R; 198/452; 214/6 D; 214/152; 271/64

[58] Field of Search ..... 214/6 D, 152; 271/64, 271/69, 177, 178, 184, 225; 198/31 AC, 32, 35, 422, 425, 442, 452; 93/93 R, 93 DP, 93 M; 209/73, 74 R, 111.7 R, DIG. 1

[56] References Cited

U.S. PATENT DOCUMENTS

| | | | |
|---|---|---|---|
| 2,075,416 | 3/1937 | Adams | 198/32 |
| 2,540,972 | 2/1951 | Wagner, Jr. et al. | 214/6 D |
| 2,697,506 | 12/1954 | Snyder | 198/35 |
| 3,355,016 | 11/1967 | Prince | 209/74 R |
| 3,523,618 | 8/1970 | Nielsen | 198/32 X |
| 3,652,828 | 3/1972 | Sather et al. | 209/111.7 R X |
| 3,839,636 | 10/1974 | Worrall | 209/DIG. 1 |

*Primary Examiner*—L. J. Paperner

*Attorney, Agent, or Firm*—Andrus, Sceales, Starke & Sawall

[57] ABSTRACT

Stacking apparatus and method for generally flat objects, particularly useful for the stacking of magazines by zip code. According to the invention, a continuous input stream of the objects is alternately diverted in preselected numbers pursuant to a shift signal to first and second hoppers or bins wherein the objects are deposited in stacks, the stacks when completed being alternately ejected from the hoppers onto common conveyor means whereon they are merged into a single output series of stacks.

In one form of the invention an input feeder receives the output flow of magazines from a labeler; a vertically shiftable separator alternately directs sequences of the generally flat objects to upper and lower feed conveyors which in turn alternately feed the sequences of objects to side-by-side hoppers. "Live" rollers moving at right angles to the feed conveyors underlie and extend as stack output conveyor means from the hoppers.

In an automatic zip code stacking embodiment of the invention, the shift signal is provided without requiring delay means from an optical reader located on the labeler that feeds the stacking apparatus, shift registration for diverting the objects being provided in the label printout wherein a label is marked for optical reading for a zip code change that is located a fixed number of labels behind the zip code change label in the sequence.

4 Claims, 20 Drawing Figures

FIG. 3
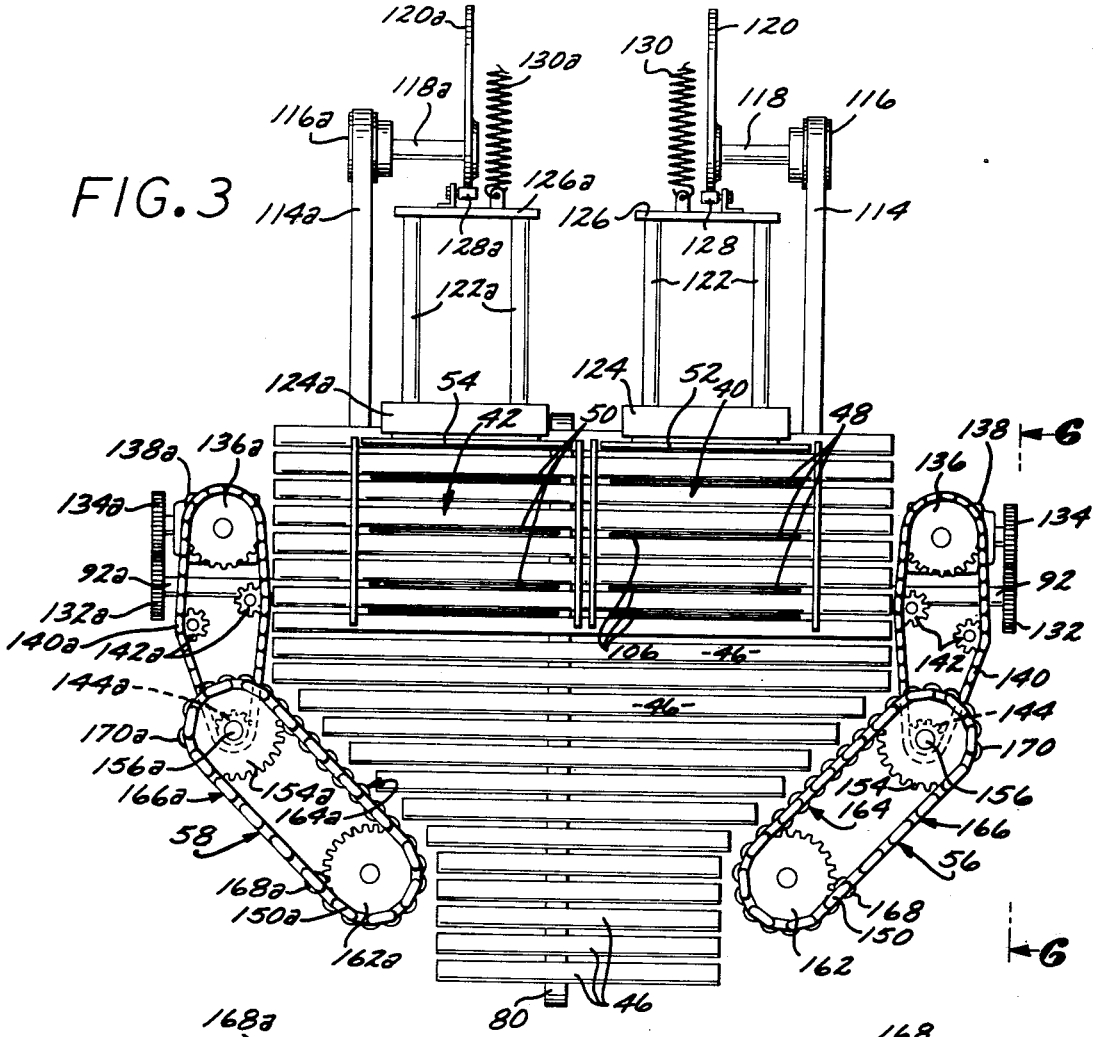
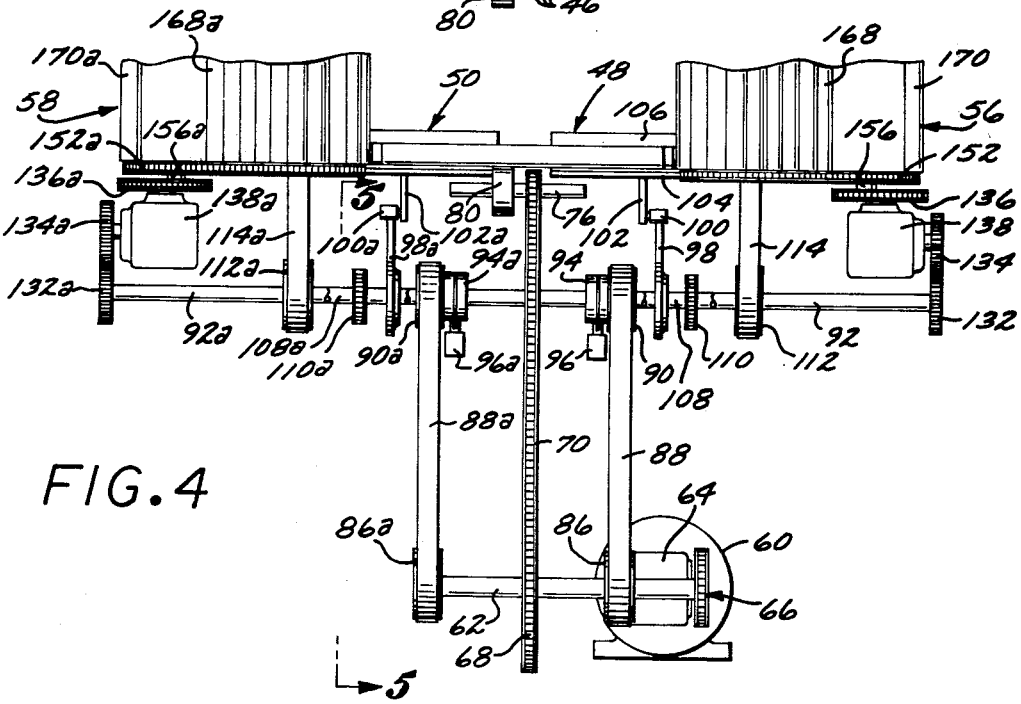
FIG. 4

7/0404-1868-1
MR. JOHN DOE
BOX 57
BONSALL CA. 92003
7/0205-0663-1
MARY SMITH
STAR RT BOX 90
BOREGO CA. 92004
7/0792-0398
MRS. T. JONES
BOX 47
BOREGO CA. 92004
64381-760-1
MISS DOE
1567 STONEMAN PL.
BOREGO CA. 92004

STACKING METHOD

This is a division of application Ser. No. 457,367, filed Apr. 2, 1974, now abandoned.

BACKGROUND OF THE INVENTION

The present invention relates in general to apparatus and methods for stacking generally flat objects, including but not limited to magazines, newspapers, and the like; and the invention relates more particularly to stacking apparatus that is adapted to stack magazines or the like that have labels thereon according to the postal zip codes on the labels, so that all labels in each stack of magazines or the like will be of the same zip code.

Automatic labeling machines for applying computer prepared labels to magazines or the like have been available for some time that are capable of labeling up to about 30,000 magazines per hour. For example, a labeling machine that is particularly suitable for feeding stacking apparatus of the present invention is a Xerox Cheshire 528 labeler, which is capable of applying labels to magazines or the like at a rate of about 27,000 per hour.

However, prior art stacking machines adaptable for "in-line" cooperation with such high speed labeling machines and capable of stacking according to zip-coded labeling, have not been capable of handling such capacity. The applicant is aware of only two prior art types of commercial stackers capable of handling zip-coded stacking. One of these is the "shuttle lock-out" approach, wherein the labeling machine is stopped for each zip code change. Thus cuts the maximum production rate to only about 60% of the potential labeler production rate. Thus, for a maximum labeling rate of about 27,000 per hour, the zip code stacking cuts the maximum possible rate to approximately 16,000 per hour, and this is further reduced to about 13,000 per hour figuring the typical down-time of about 20%.

The second prior art type of commercial stacker of which the applicant is aware that is capable of handling zip code stacking is the "interceptor plate" type, wherein each zip code is stacked on a "false shelf" interceptor plate. When a zip code has stacked, up to a maximum of about 8 inches thick, the plate cycles out and back in between adjacent magazines of different zip codes. This involves the plate shifting out of the way, the stack falling about 9 inches, and the plate than shifting back into position to catch the very next magazine, which starts the next zip code stack. This approach requires that the labeler be slowed down to approximately 14,000 per hour to accommodate the stacker speed limitation of about 15,000 to 16,000 per hour. With any greater speed of operation of the stacker, the plate starts coming back too soon and hitting the stack. With the typical 20% down time, the 14,000 per hour capability of this type stacker is reduced to a net of about 11,000 per hour.

It will thus be seen that much of the capacity of conventional labeling machines could not heretofore be utilized with zip coded labeling because of the inadequacy of available zip code stackers.

Another problem in connection with such zip code stackers was the manner in which shift registration was accomplished. The first label in each zip code was suitable so as to be registered by an optical reader associated with the labeling machine, and the resulting signal was required to be delayed the entire length of time for the corresponding label and its associated magazine to be fed to the stacker. In the aforesaid shuttle lock-out type of stacker, this involves a two-label magazine cycle delay in the signal before its operational application; while in the aforesaid interceptor plate type of stacker this involved the use of a minicomputer to provide about a 40-label magazine cycle delay of the signal before its application. These extended time delays between the reading and the application of the shift signal introduced undesirable complexities into the prior art apparatus, with resulting loss in reliability.

A third type of prior art stacker is the "rotary indexing" type stacker, wherein a big wheel having a series of peripheral compartments is indexed to successive compartments for receiving successive stacks in the compartments, usually stacks of the same numbers of magazines or the like, as for example 25 magazines in each stack. The rotary indexing type stacker is quite slow in operation, and is not suitable for zip code stacking.

OBJECTS AND SUMMARY

In view of these and other problems in the art, it is an object of the present invention to provide stacking apparatus for generally flat objects such as magazines, newspapers, or the like, which is not limited by speed limiting steps or apparatus such as a shuttle lock-out step or interceptor plate apparatus, and which therefore is particularly adaptable for in-line cooperation with a high speed labeling machine for zip coded or other indexed stacking of the labeler output.

Another object of the invention is to provide stacking apparatus of the character described wherein a continuous conveyed flow of magazines or the like is shiftable between successive stacks without stopping, delaying, or otherwise interrupting the flow of the magazines, in response to a shift signal pulse. When the stacker is operatively coupled to the output of a zip coded labeling machine, such shift pulses may be provided by optically reading suitable label marks indicating a zip code change. However, it is to be understood that the present stacker can also be used in connection with an indexing programming which pulses the stacker according to any set or variable program, rather than an optically read zip code mark on a label. Thus, for example, such a set program may pulse the stacker for providing stacks of equal numbers of magazines or other objects.

Another object of the invention is to provide a novel shift registration system for use of the present invention in zip code stacking, wherein the shift registration is provided in the main computer printout. This is accomplished by having the optically read marks disposed on a label that is a fixed number of labels back in the line from the label that bears the zip code change, as for example two labels back for each nip code change. This obviates the need for apparatus or circuitry employed to delay the indexing signal for the traverse of a plurality of magazines in the system prior to application of the signal to the stacker, which was the prior art approach.

A further object of the invention is to provide a novel mechanical arrangement including an upper feed station having an input feeder, a vertically shiftable separator or diverter, and upper and lower feed conveyors; these elements cooperating with a lower stacking station that includes a pair of side-by-side hoppers or bins that receive the magazines from the respective upper conveyors, a deck of live rollers extending from under the hoppers at right angles to the feed conveyor direction, vertically shiftable bladed platforms which extend upwardly between the live rollers to catch the magazines while they are stacking, and adapted to drop below the rollers to release a stack onto the live rollers when it is completed, pusher plates associated with the hoppers for pushing the completed stacks up to the output movement speed of the live rollers; and converging merging units on opposite sides of the live rollers which shift the successive stacks from the two hoppers into line for output movement of the stacks along the rollers.

A further object is to provide a novel sequencing method and apparatus, including cooperating mechanical components of the upper feed station and lower stacking station, and electrical intelligence associated therewith, for causing the successive feeding of stacks of magazines or the like to the two hoppers or bins; the successive dropping of the stacks onto the live rollers and pushing the stacks up to speed; and the successive merging of the stacks into output alignment.

In an "in-line" system for the production of magazines after the printing thereof, it is desirable to have the whole line operate at a speed that is compatible with the labeling machine. Thus, with presently available labeling machines capable of netting at least 20,000 units per hour, it is desirable to have the whole line operate at a rate of at least 20,000 per hour. Any piece of equipment in the line that is slower will slow the entire line down, and correspondingly increase the cost of production.

A typical in-line system embodying the present invention will include the following stations:

1. A stitcher and trimmer station, including a pair of stitching machines such as McCain stitcher machines. Such a stitcher and trimmer machine puts the plurality of four "Signatures" together to make the magazine, puts the staples in, and trims the magazine. Since physical limitations enable such stitching machines to only net about 10,000 magazines per hour, it is necessary to have two of them operating in parallel in the line.

2.A merging station, which can be either automatic or manual, for converging the outputs of the two stitching machines together into a single moving line.

3. A labeling machine, as for example a Xerox Cheshire 528 labeler, which is capable of netting at least 20,000 per hour.

4. The stacking apparatus according to the present invention, which is also capable of netting more than 20,000 per hour.

5. A bundle tying machine capable of handling the high rate of output of the magazine stacks from the present stacking machine. Such a bundle tying machine is disclosed in applicant's U.S. Pat. No. 3,568,591, issued Mar. 9, 1971 for "Automatic Tying Apparatus".

The present system is particularly useful for zip code stacking not only because of its speed and reliability resulting from the direct application of the optically read zip code shift signal, but also because of the uninterrupted feeding of magazines or the like permitted by the apparatus. Even at full labeler speed of up to 27,000 or more magazines per hour, the present invention is capable of handling the minimum zip code stacks of six specified by postal regulations, by employing a unique cycle overlap of up to 50%, wherein the vertically shiftable platform and pusher plate associated with a stacking hopper may complete their functions in the removal of a first stack from the hopper within the first half of a cycle for that side of the lower stacking station, permitting a third stack in the sequence to be accumulating in that hopper during the last half of the cycle for that side while a second stack in the sequence is being moved out of the other hopper in the first half of the cycle for the other side.

On the other hand, there is no inherent limitation to the thickness of the stacks which can be provided in the present apparatus, stacks of magazines up to a foot or more thick being practical. Thus, there is no problem providing the maximum stacks of 25 specified by postal regulations.

Other objects, aspects and advantages of the present invention will be apparent from the following description taken in connection with the accompanying drawings, wherein:

BRIEF DESCRIPTION OF THE DRAWINGS

FIG. 3 is a diagrammatic top plan view of the lower stacking station of the apparatus.

FIG. 4 is a fragmentary diagrammatic front elevational view of the lower stacking station, particularly illustrating the continuous connection to the live rollers and the single revolution drive connections for successively sequencing the right and left-hand sides of the lower stacking station.

DETAILED DESCRIPTION

Figure 1:
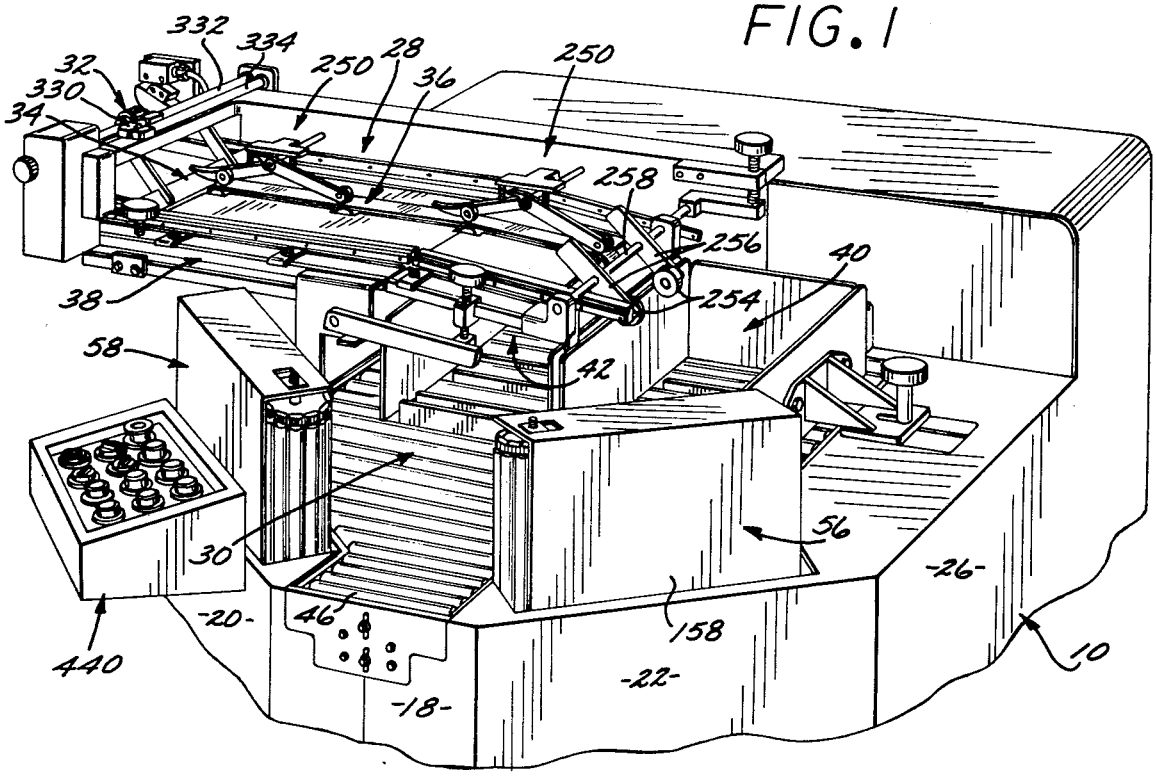
FIG. 1 is a perspective view of the upper part of a stacker according to the present invention, illustrating the upper feed and lower stacking stations thereof.

Referring to the drawings, the stacker that is illustrated and described in detail herein is particularly adapted to receive magazines or the like from a labeling machine and to stack them according to zip code. However, it is to be understood that the present invention is not limited to stacking for zip code separation purposes, nor is it limited to the stacking of magazines. For example, a stacker according to principles of the present invention may be programmed to stack newspapers in stacks of predetermined numbers. In general, the invention is adaptable for the stacking of any generally flat, stackable objects, and has particular utility where such generally flat objects are provided in a very rapid flow stream, as for example a stream of magazines from a labeler, or a stream of newspapers directly off of a press.

GENERAL ARRANGEMENT OF THE ELEMENTS

Figure 2:
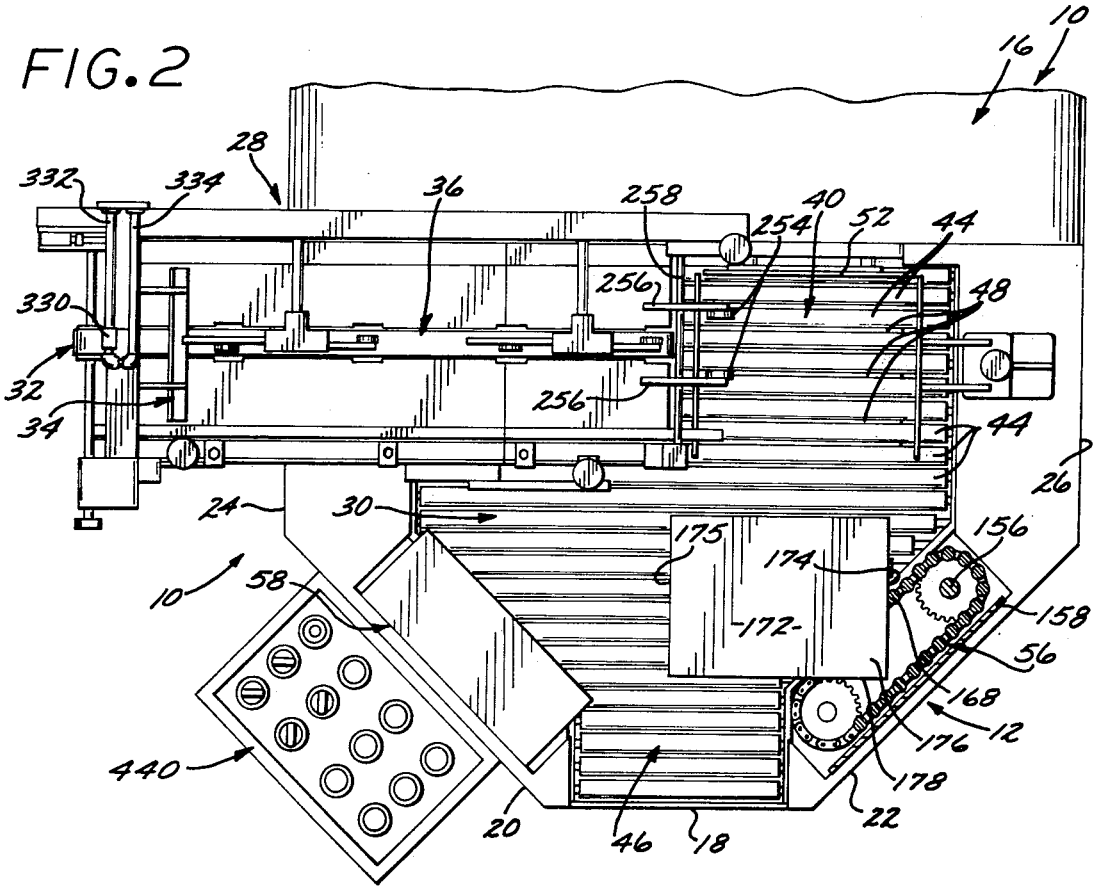
FIG. 2 is a top plan view of the stacker.

FIGS. 1 and 2 illustrate the general arrangement of stacking apparatus according to the invention. The stacker, generally designated 10, includes a forward housing portion 12 having a horizontal platform 14 at table height, and a raised rearward housing portion 16 which projects upwardly and rearwardly from the horizontal platform 14. The front of the housing is segmented to include a transverse forward wall 18 and a pair of rearwardly inclining walls 20 and 22. The sides of the housing will be referred to herein as the left or input side 24 and the right side 26, since most of the illustrations are taken looking generally from the front of the apparatus.

The stacking apparatus 10 includes two main mechanical components: an upper feed station 28, which is spaced above the horizontal platform 14; and a lower stacking station 30, which is located generally at the level of the horizontal platform 14. As will be described in detail hereinafter, the upper feed station 28 includes an input feeder 32 consisting of a pair of opposed belts or rollers which receive the magazines or other flat objects and slow them down to minimum separation for best handling; a separator or diverter 34 to provide vertical separation of the incoming stream of magazines or other objects to be stacked; and upper and lower conveyors 36 and 38, respectively, for receiving streams of the magazines or other objects from the separator or diverter 34 and conveying them to separate hoppers or bins forming a part of the lower stacking station 30. The input feeder 32, separator or diverter 34, and conveyors 36 and 38 are all generally transversely aligned, with the input feeder 32 spaced to the left of the left side 24 of the housing for convenient association of the input with a labeling machine or other source of magazines or the like to be stacked.

The lower stacking station 30 generally includes a pair of hoppers or bins 40 and 42 that are arranged side-by-side so as to be generally aligned with the conveyors 36 and 38, the right-hand hopper or bin 40 being located under the output end of the upper conveyor 36, and the left-hand hopper or bin 42 being located under the output of the lower conveyor 38. The lower stacking station also includes an array of "live" or continuously driven rollers 44 located proximate the level of horizontal platform 14 and which extend from the bottoms of hoppers or bins 40 and 42 forwardly to a narrowed output end section 46 thereof proximate the forward wall 18; a pair of vertically shiftable platforms 48 and 50 normally forming the bottoms of the respective hoppers 40 and 42, respectively, and consisting of blades which extend upwardly between live rollers 44 and are downwardly retractable to release respective stacks of magazines or the like onto the live rollers 44; a pair of transverse, vertical pusher plates 52 and 52 normally forming the rear walls of the respective hoppers 40 and 42, but which are forwardly shiftable to push respective stacks of magazines forwardly up to the forward surface speed of the live rollers 44; and right and left merging units 56 and 58, respectively, projecting upwardly from the horizontal platform 14 adjacent the front of the apparatus, and adapted to receive stacks of magazines from the respective hoppers 40 and 42 and sequentially shift them laterally into alignment for output movement along the output section 46 of live rollers.

THE LOWER STACKING STATION

Details of the lower stacking station 30 are shown in FIGS. 1 to 7 of the drawings. Both the continuously driven and intermittently driven portions of the lower stacking station 30 are driven from he same prime mover, an electric motor 60, which drives a main drive shaft 62 through a gear box 64 and chain and sprocket assembly 66. The main drive shaft 62 is continuously driven at constant speed by the motor 60 and drive connections 64 and 66, and is horizontally, transversely arranged in a lower central position substantially below the horizontal platform 14. The various drive connections from main drive shaft 62 to the different movable portions of the stacking station 30 are illustrated in detail in FIGS. 3 to 7 of the drawings.

THE "LIVE" ROLLERS

Figure 5:
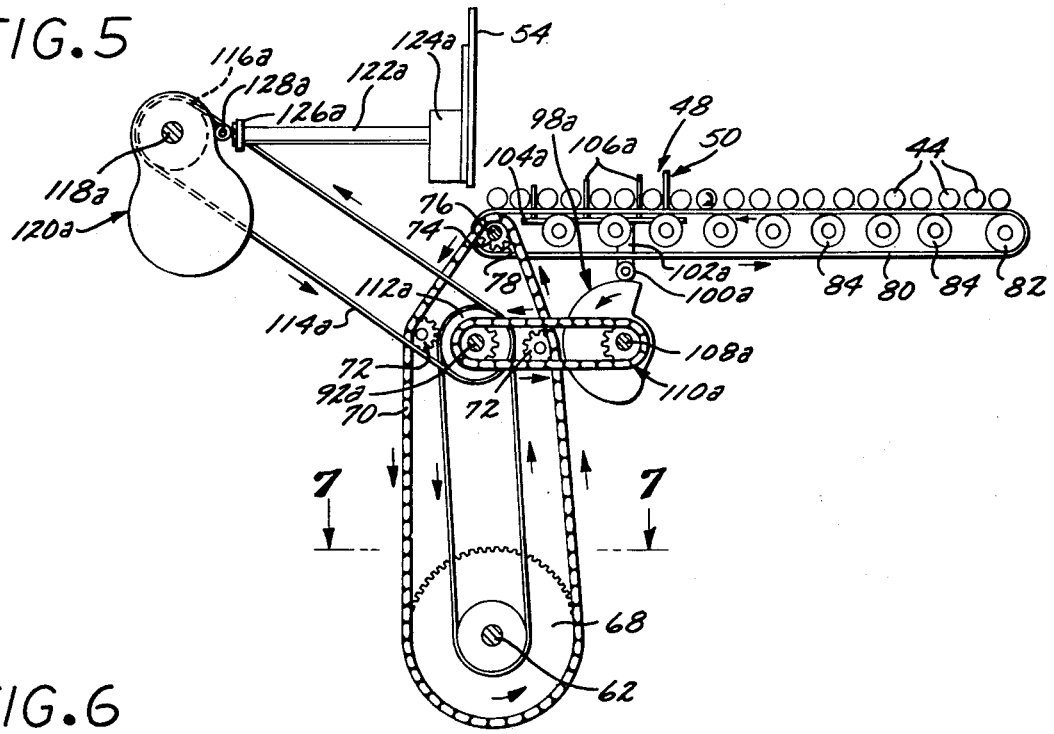
FIG. 5 is a vertical section taken on the line 5—5 in FIG. 4, further illustrating the lower stacking station drive connections to the live rollers, to the left-hand vertically shiftable platform, and to the left-hand horizontally shiftable pusher plate.
Figure 7:
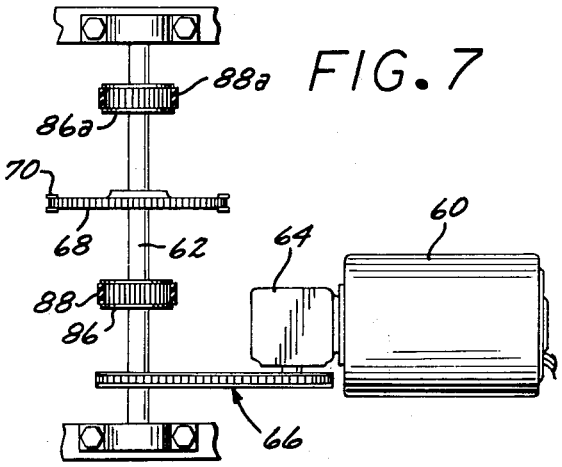
FIG. 7 is a fragmentary horizontal sectional view taken on the line 7—7 in FIG. 5, illustrating the lower part of the drive for the lower stacking station.

The continuous drive to the live rollers 44 is seen in FIGS. 4, 5 and 7, and includes a large drive sprocket 68 on main drive shaft 62 which drives a chain 70 that extends over a pair of idler sprockets 72 so as to avoid other drive components, and drives a driven sprocket 74. The driven sprocket 74 is keyed to a shaft 76, which in turn is keyed to a belt drive pulley 78 that drives a cog belt 80 arranged in a horizontal loop between the pulley 78 and an idler 82. The belt 80 immediately underlies the live rollers 44 and is arranged in the front-rear direction at right angles to the live rollers 44. Belt 80 is biased into driving engagement with the rollers 44 by means of a series of idler wheels 84 engaged under the belt 80 preferably intermediate sequential pairs of the live rollers 44. As viewed in FIG. 5, which is looking from the left-hand side of the apparatus, main drive shaft 62 and its sprocket 68 rotate anticlockwise, whereby the driven sprocket 74 and belt drive pulley 78 are also driven anticlockwise, and the upper length of belt 80 which engages live rollers 44 travels to the left, thereby rotating the live rollers clockwise. Thus, the exposed upper surfaces of the live rollers 44 will travel at constant speed to the right or forwardly of the apparatus.

Except for the constantly moving live rollers 44, each side of the lower stacking station 30 cycles independently of the other, the right-hand and left-hand sides cycling alternately. As will be described in more detail hereinafter, if a hopper on one side receives twelve or more magazines, its cycle will be sequential to the previous cycle of the other side; whereas if a hopper on one side receives less than twelve magazines, then its cycle will overlap the previous cycle of the other side, down to a 50–50 overlap for a minimum number of six magazines.

RIGHT-HAND SIDE OF LOWER STACKING STATION

Referring to the right-hand side of the lower stacking station 30, a pulley 86 keyed to the main drive shaft 62 drives a cog belt 88 which continuously drives a pulley 90 that is coaxial with but normally disengaged from right drive shaft 92. A cycle of the right-hand side of stacking station 30 is effected by a single revolution of the right drive shaft 92 caused by engagement of a single revolution clutch 94 that is selectively engageable between pulley 90 and shaft 92 upon energization of clutch solenoid 96. Assuming the separator or diverter 34 to be in its up position supplying magazines to upper conveyor 36 which is feeding the magazines to right-hand hopper 40, a shift signal (derived from the labeling machine as described hereinafter in detail) will cause the separator 34 to shift to its down position terminating the flow of magazines to upper conveyor 36; and this same shift signal will, after a suitable time delay for the magazines remaining on the upper conveyor 36 to be fed to the right-hand hopper 40, energize the single revolution clutch solenoid 90 so as to cycle the right-hand side of the stacking station 30. Such cycling includes dropping of the vertically shiftable platform 48 to release the stack of magazines onto the live rollers 44, simultaneous forward movement of the pusher plate 52 to push the stack up to roller speed, and actuation of the merging unit 56 through a complete revolution thereof. Such cycling of the right-hand side also includes retraction of pusher plate 52 and movement back upwardly of platform 48 by the time one-half or 180° of the cycle has occurred, and while the merging unit 56 is still moving in its cycle that lasts through the complete 360° cycling.

THE RIGHT-HAND VERTICALLY SHIFTABLE PLATFORM

The right-hand vertically shiftable platform 48 is normally in its raised position as seen FIG. 4, being held there by engagement of a cam 98 with a cam follower 100 located on a depending arm 102 of the platform 48. The platform 48 includes a horizontal base plate 104 from which the arm 102 depends, and upon which a series of platform blades 106 are mounted. The blades 106 are transversely arranged and spaced apart in the front-rear direction, projecting vertically upwardly between adjacent pairs of the live rollers 44. The blades 106 descend in height from front to rear so that the normal bottom of the hopper 40 will incline rearwardly so as to tend to retain a stack of magazines in the hopper.

The cam 98 is keyed to a separate cam shaft 108 disposed forwardly of and parallel to the right drive shaft 92, cam shaft 108 being driven in a one-to-one ratio for a single cycling revolution from right drive shaft 92 through chain and sprocket assembly 110. While the right-hand cam 98 and its mounting and driving means are illustrated in FIG. 4, they will be best understood by reference to the illustration in FIG. 5 of the corresponding left-hand cam and its drive which are described hereinafter.

Cycling of the right drive shaft 92 causes a single revolution of the cam 98. When cam 98 has traveled through approximately 20°, it drops the cam follower 100 and hence the entire platform 48 down so that all of the platform blades 106 clear the exposed upper surfaces of the live rollers 44 in the hopper 40. The cam 98 then shifts the cam follower 100 and hence the entire platform 48 back upwardly within 180° of its rotation and at the end of the cycle the cam 98 will again be in its initial position holding the platform 48 in its uppermost position.

THE RIGHT-HAND PUSHER PLATE

Motivation is provided for the pusher plate 52 from a pulley 112 keyed on right drive shaft 92, the pulley 112 driving a cog belt 114 which in turn drives a pulley 116. Pulley 116 is keyed on cam shift 118 upon which cam 120 is supported. The drive between right drive 92 and cam shaft 118 is one-to-one, so that the cam 120 is rotated through a single revolution for each cycling of the right drive shaft 92.

Pusher plate 52 is supported on a pair of spaced, parallel, horizontal, longitudinally arranged rods 122 which extend rearwardly from the plate 52 and are slidably mounted in a linear motion bearing block 124. The rods 122 are connected at their rear ends by a transverse bar 126 upon which a cam follower 128 is supported so as to be in engagement with the periphery of cam 120.

In the position of repose of the parts between cycles as illustrated in FIGS. 3 and 4, the cam follower 128 is located on the lowermost peripheral region of cam 120, so that the pusher plate 52 is in its fully retracted, rearwardmost position. Approximately 20° into a cycle the cam 120 pushes the follower 128, and hence the entire pusher plate assembly, forwardly so as to move the stack of magazines or the like forwardly up to the speed of the live rollers 44, the pusher plate 52 reaching its forwardmost position of travel corresponding to engagement of cam follower 128 by the highest point on cam 120 before the cycle has progressed 90°. As the cycle progresses further, the cam follower 128 is lowered back down onto the lowermost part of cam 120 so as to allow retraction of the pusher plate 52, which is completed within the first 180° of the cycle. The pusher plate assembly is biased rearwardly for retraction by means of a tension spring 130 extending rearwardly from the transverse bar 126.

A full understanding of the drive for right-hand pusher plate 52 will be assisted by reference to FIG. 5, which illustrates in elevation the corresponding drive mechanism for the left-hand pusher plate 54.

It will be apparent from the foregoing description that the vertical shifting movements of right-hand platform 48 and the horizontal shifting movements of right-hand pusher plate 52 are substantially synchronous. These movements differ, however, in that the vertical shifting of platform 48 involves a sudden drop, and a fast return rise, both of which are short movements; in contrast, the pusher plate 52 is moved much further in its travel, and its starting and returning movements are more gradually initiated.

THE RIGHT-HAND MERGING UNIT

Cycling of the right-hand merging unit 56 is effected through a drive gear 132 keyed on the right drive shaft 92, the gear 132 driving a driven gear 134, which in turn drives a sprocket 136 about a vertical axis through an angle drive 138. The sprocket 136 drives a chain 140 over a pair of tensioning idler sprockets 142, the chain 140 in turn driving the input sprocket 144 of merging unit 56.

Figures 13, 14, 15, 16, 17:
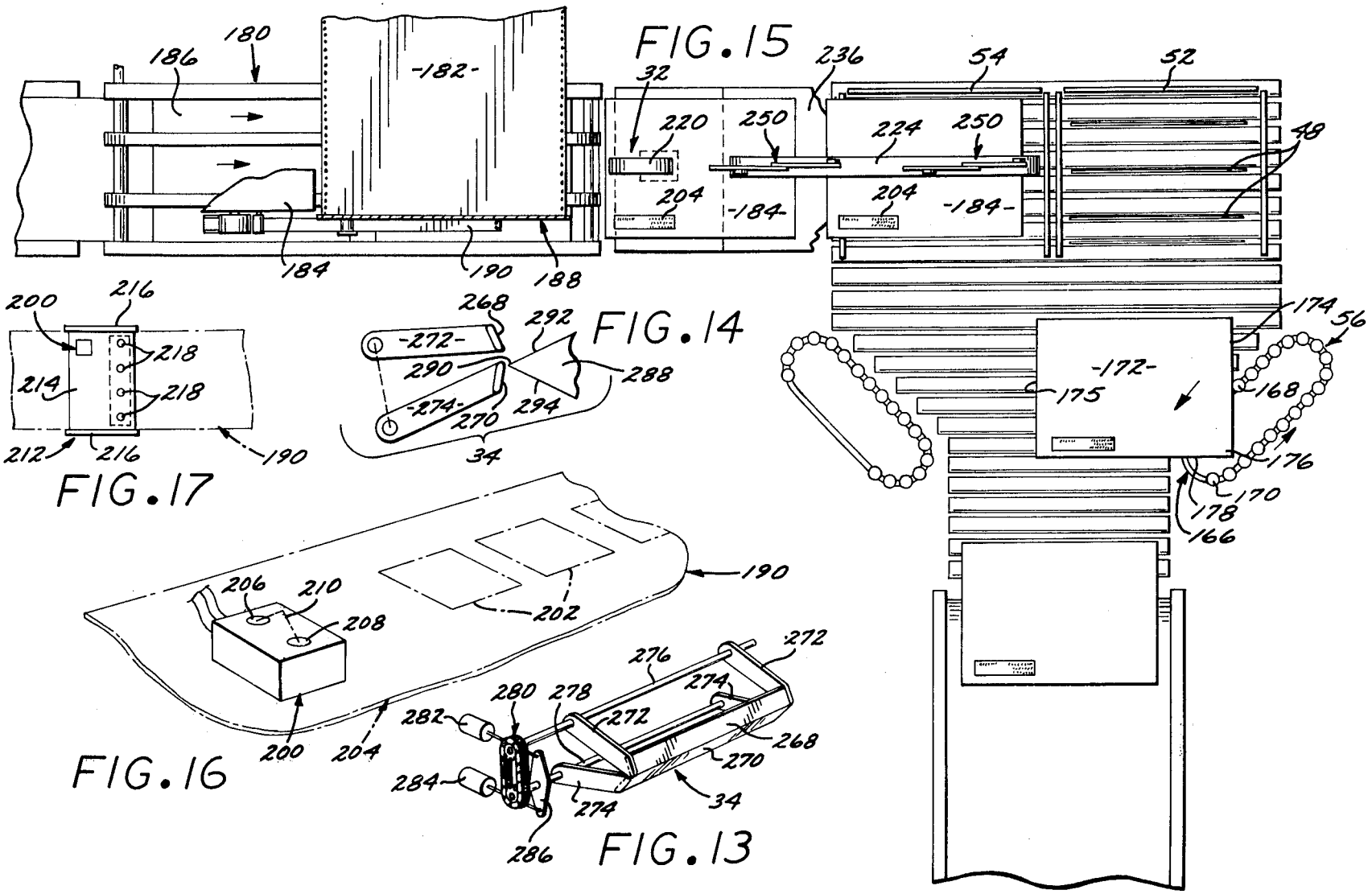
FIG. 13 is a fragmentary perspective view illustrating the separator or diverter forming a part of the upper feed station.
FIG. 14 is a diagrammatic fragmentary elevational view illustrating the cooperative relationship between the feed fingers and the divider blade which form parts of the separator or diverter.
FIG. 15 is a diagrammatic top plan view taken on the line 15—15 of FIG. 10.
FIG. 16 is a diagrammatic fragmentary perspective view, with portions in phantom, illustrating the manner in which the optical reader cooperates with a label in the reading of shift registration marks thereon.
FIG. 17 is a top plan view showing the optical reader and its associated label strip guide, with a label shown in phantom in cooperation therewith.

The merging unit 56 comprises a generally oval array (viewed in plan or horizontal section) of vertically oriented, parallel idler rollers 146 which are supported between a pair of complementary vertically spaced lower and upper chains 148 and 150 which lie in respective horizontal planes. As best seen in FIGS. 1, 2 and 3, the ovals of chains 148 and 150, and hence the oval of the array of rollers 146, are angled forwardly and inwardly toward the front-rear centerline of the apparatus at about a 45° angle. The lower and upper chains 148 and 150 are driven at the rearward, outer ends of the chain ovals on respective drive sprockets 152 and 154, both of which are keyed on a vertical drive shaft 156 that is journaled in horizontal top and bottom walls of a merger housing 158 which is completely open on its rearwardly and inwardly facing side and on its forwardly and inwardly facing end so that the corner of a stack of magazines may pass therethrough as illustrated in FIGS. 2 and 15. The vertical drive shaft 156 is driven by the previously described input sprocket 144 which is secured to the lower end of shaft 156.

The forward and inward ends of the loops of lower and upper chains 148 and 150 are supported and defined by respective vertically spaced idler sprockets 160 and 162 mounted on top and bottom walls of the merger housing 158.

The vertical idler rollers 146 are arranged along the chains 148 and 150 in closely spaced relationship to each other, but this movable wall 164 of freely rotatable rollers 146 does not extend all of the way around the chain loops, being interrupted in a gap or opening 166 extending approximately one-quarter of the loop length. This gap or opening 166 in the wall or web 164 of rollers is defined between a leading pusher roller 168 and a trailing roller 170.

Figure 6:
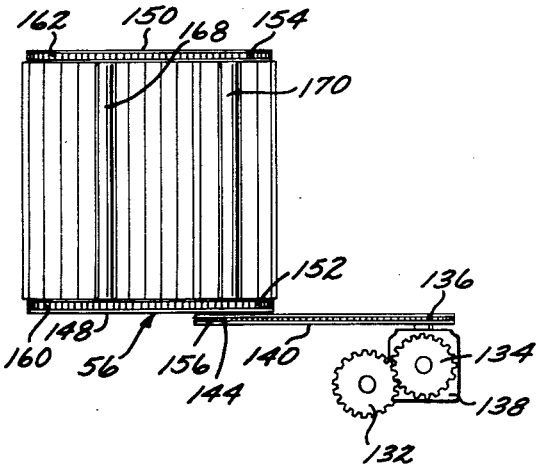
FIG. 6 is a fragmentary diagrammatic side elevational view taken on the line 6—6 in FIG. 3, particularly illustrating the right-hand merging unit and part of the drive thereto.

In the position of repose of the right-hand merging unit 56, as illustrated in FIGS. 3, 4 and 6, the gap 166 is on the side of the loop facing outwardly, and there is a solid wall or web of the idler rollers 146 facing inwardly, and in particular extending across the space between the drive sprockets 152 and 154 at the one end and the idler sprockets 160 and 162 at the other end, and extending around the idler sprockets 160 and 162. This solid, inwardly facing wall of freely rotatable rollers 146 then serves as a guide in the position of repose of the merging unit 56 for a stack of magazines or the like that may be coming off of the other merging unit 58.

The drive connections between right drive shaft 92 and roller chains 148 and 150 are geared up as an overdrive, principally by having the drive sprocket 136 substantially larger than the input sprocket 144, so that the chains and accompanying idler rollers 146 will traverse exactly one complete loop and arrive back at their starting points during one cycle, which is a single revolution of the right drive shaft 92. The leading pusher roller 168 at the trailing edge of the gap 166 is positioned and timed so that it will engage a stack 172 of magazines or the like midway along the length of the right-hand edge 174 of the stack 172 as the stack is moving forwardly along the live rollers 44 so as to slide the stack 172 to the left as it is moving forwardly on the live rollers 44. By engaging the stack 172 midway along the edge 174, the force of pusher roller 168 against the stack 172 will not tend to pivot or cant the stack, whereby when the stack has been merged into line with the output end section 46 of the live rollers 44 it will still have its edge 174 and its opposing edge 175 generally axially aligned with the movement of the stack.

In order to retain this central positioning of the pusher roller 68 against the right-hand edge 174 of the stack as the stack travels forwardly and to the left along the live rollers 44, it is essential that the forward component of movement of the pusher roller 168 have a velocity that is the same as the surface velocity of the live rollers 44 and hence the velocity of forward movement of the stack 172. With the chain and roller loop of merging unit 56 set at a 45° angle relative to the longitudinal or front-rear direction of movement, this requires a linear velocity for the chains 148 and 150 and idler rollers 146 of 1.414 times the surface velocity of the live rollers 44 and hence the forward movement component of the stack 172. Since the chains and associated idler rollers must complete a full anticlockwise circuit of the loop to their initial starting points during one cycle of operation, the lengths of the chains 148 and 150 will be determined by this linear speed that the chains and hence the pusher roller 168 must have in order that its forward component will match the surface speed of the live rollers 44.

There are several additional criteria for the merger unit 56. One is that the sides of the chain and roller loop be spaced apart sufficiently so that the corner 176 of the stack 172 clears the rollers 146 on the outside part of the loop that are moving to the rear and outwardly. For a typical magazine of 8½ inch by 11 inch size, the pusher roller 168 will engage the edge 174 about 4¼ inches to the rear of corner 176, and the corner portion of the stack will project approximately 3 inches into the merger 56 beyond the line of movement of the pusher roller 168. Preferably at least about an additional inch of clearance will be provided, so that there will be at least about 4 inches between the sides of the loop. Another factor is that the width of the gap 166 must be substantially greater than the width of the corner portion of the stack 172 that extends through the gap. In the example wherein magazines are about 8½ inches by 11 inches, such corner portion of the stack on a 45° angle line coincident with the line of movement of the pusher roller 168 is about 6 inches, and for this example it is preferred to have the gap 166 at least about 8 inches wide along the length of the loop so that the trailing roller 170 will be able to move around to the outside of the loop ahead of the oncoming leading edge 178 of the stack as illustrated in FIG. 15 of the drawings. In this connection, it is to be noted that the idler sprockets 160 and 162 at the forward, inner end of the merger are not carried by a connecting shaft, but are simply rotatably supported at the bottom and top, respectively, of the merger housing 158, whereby the corner portion of the stack 172 may freely move forwardly and inwardly through a completely open forward end of the merger. It is also to be noted that the lower chain 148 and its sprockets 152 and 160 are offset below the surfaces of the live rollers 44 so as to provide the necessary vertical clearance for movement of the corner section of the stack 172 forwardly and inwardly along the merger.

While the movements of both the vertically shiftable platform 48 and the horizontally shiftable pusher plate 52 are completed within the first half of a cycle, the merger 56 continues to move during the entire cycle, coming to a rest only at the termination of the cycle. In the positions of the stacks 172 as illustrated in both FIG. 2 and FIG. 15, the merger 56 has traveled through more than half of its cycle, yet is it still actively functioning with respect to the stack 172. Nevertheless, since more than 180° of the cycle has passed, the platform 48 and pusher plate 52 have returned to their initial positions so as to clear the hopper 40 to receive a new stack of magazines or the like. In the case of minimum stacks, such as for example stacks of only six magazines, there may be up to a 50% overlap between the cycles of the right-hand and left-hand sides of the apparatus, whereby with a stack 172 in the process of being merged by the right-hand merging unit 56 as illustrated in FIGS. 2 and 15, the stack in the left-hand hopper 42 will have been completed and will be in the process of being moved forwardly by the respective pusher plate 54, and a new stack will be forming in the right-hand hopper 40. With such minimum stacks and a corresponding maximum overlap in the operation of the sides of approximately 50%, successive stacks from the alternate sides may be as close as about 1½ inches to each other in the longitudinal or front-rear direction, so that only about 10 inches need be allowed per stack in the front-rear direction for the example of 8½ inch by 11 inch magazines.

It will be seen that should the stack 172 inadvertently be slid too far to the left by the right-hand merger 56, its left-hand edge 175 will be simply guided in the forward direction by the exposed freely rotating idler rollers at the forward, inner end of the left-hand merging unit 58.

LEFT-HAND SIDE OF LOWER STACKING STATION

The left-hand side of the lower stacking station 30 is essentially the same as the right-hand side described above, both structurally and in operation. Thus, the drive to the left-hand side initiates from main drive shaft 62 through pulley 86*a*, cog belt 88*a* and pulley 90*a* that drives left drive shaft 92*a* in increments of a single revolution by means of the single revolution clutch 94*a* that is actuated by the clutch solenoid 96*a*. Single revolution clutch solenoid 96*a* functions to cause a single revolution cycling of the left drive shaft 92*a* each time the separator or diverter 34 flips from its down position, wherein it was feeding magazines or the like to the left-hand hopper 42, to its up position, the clutch solenoid 96*a* being energized from the same signal source as the separator 34 but after a delay suitable to allow completion of the transit of the magazines or the like along the lower conveyor 38 and into the hopper 42.

THE LEFT-HAND VERTICALLY SHIFTABLE PLATFORM

The left-hand vertically shiftable platform and the manner in which it is cycled are particularly well illustrated in FIG. 5, and are also illustrated in FIG. 4, these figures illutrating the left-hand platform 50 in its raised position, which is its normal position of repose. The platform 50 is held in this position by means of cam 98*a* which is holding cam follower 100*a* in an uppermost position, the follower 100*a* being mounted at the lower end of arm 102*a* that depends from platform base plate 104*a*. In this position the transversely arranged, vertical platform blades 106*a* project upwardly between adjacent pairs of the live rollers 44, with the level of the blades descending from front to rear so that the actual platform encountered by a stack of magazines or the like, which is the upper horizontal edges of the blades 106*a*, tilts rearwardly to hold the magazines or the like in position until it is time for them to be ejected from the hopper.

The cam 98*a* is supported on cam shaft 108*a* that is positioned forwardly of and parallel to the left drive shaft 92*a*, being driven at a one-to-one ratio for a single revolution per cycle through chain and sprocket assembly 110*a*. As illustrated in FIG. 5, shafts 62, 92*a* and 108*a* all rotate anticlockwise. It will be seen that when the cam 98*a* has progressed approximately 20° in the anticlockwise direction from its initial position that is illustrated in FIG. 5, the cam follower 100*a* will drop abruptly off of the cam lobe so as to drop the platform blades 106*a* all completely below and clear of the upper surfaces of the lie rollers 44. The platform will remain in its dropped position until the cam 98*a* has progressed a little less than 180°, at which point the cam raises the cam follower 100*a* and hence the blades 106*a* back up to the position shown in FIG. 5 for receiving another stack of magazines or the like, which can commence being fed onto the platform 50 defined by blades 106*a* when the left-hand cycle is thus only approximately 50% completed.

THE LEFT-HAND PUSHER PLATE

The cam actuating mechanism for the left-hand pusher plate 54 is also particularly well illustrated in FIG. 5, but further illustrated in FIGS. 3 and 4. The single revolution rotary cycling movement is provided from left drive shaft 92*a* through pulley 112*a* keyed thereon and cog belt 114*a* to cam drive pulley 116*a* that is keyed on cam shaft 118*a* upon which the cam 120*a* is supported. Left-hand pusher plate 54 is supported on the front ends of parallel rods 122*a* that are slidably mounted in linear motion bearing block 124*a*. Transverse bar 126 joins the rear ends of rod 122*a* as a yoke, cam follower 128*a* being supported on the bar 126*a* so as to be operatively engaged by the cam 120*a*.

As is clearly seen in FIG. 5, in the position of repose or starting position of the cam 120*a*, the left-hand pusher plate 54 is completely retracted to the rear, forming the rear wall of the hopper 42. In this position of the cam 120*a*, the cam follower 128*a* is engaged against the lowermost level of the cam 120*a*. Upon the initiation of a cycle, the cam 120*a* commences to rotate anticlockwise as viewed in FIG. 5, and the cam lobe will commence moving the cam follower 128*a* forwardly within about 20° of rotation of the cam. The highest point on the cam lobe will come into engagement with the cam follower 128*a* corresponding to maximum forward travel of the pusher plate 54 in slightly less than 90° of rotation of the cam 120*a*, after which point further rotation of the cam 120*a* will allow rearward movement of the cam follower 128*a* and hence of the pusher plate 54, which rearward movement is effected by the tension spring 130*a*. The cam follower 128*a* will have moved completely off of the cam lobe and back down to the lowermost region of the cam 120*a* in less than 180° of travel of the cam 120*a*, whereby cycling of the pusher plate 54 has been completed within the first 180° of a cycling of the left-hand side of the apparatus.

THE LEFT-HAND MERGING UNIT

The merging unit 58 is cycled from left drive shaft 92*a* through gears 132*a* and 134*a*, angle drive 138*a* and its output sprocket 136*a*, and then the drive chain 140*a* which connects sprocket 136*a* to merger input sprocket 144*a*.

The details of construction and operation of the left-hand merging unit 58 are the same as those described hereinabove in detail with respect to the right-hand merging unit 56, except for the fact that the left-hand merging unit 58 cycles in cooperation with the cycling of the left-hand vertically shiftable platform 50 and horizontally shiftable pusher plate 54, and the left-hand merging unit 58 travels clockwise during operation viewed from above, as distinguished from the anticlockwise travel of right-hand merging unit 56.

LABELING MACHINE ASSOCIATED WITH THE STACKER

FIGS. 8 through 17 illustrate the details of the upper feed station 28, and show the stacking apparatus 10 operatively arranged in association with a labeling machine 180 for use of the stacking apparatus 10 as a zip code stacker. A labeling machine which is suitable for this purpose is a Xerox Cheshire 528. The labels are provided on a continuous printout sheet 182 from a computer which is fed to the labeler 180 horizontally and transverse to the longitudinal direction of movement of the magazines or the like 184 that are moving along the labeler conveyor 186 in the direction from left to right as viewed in FIGS. 10, 11 and 15. The computer printout sheet 182 is arranged in successive strips of four labels each extending across the sheet 182 in the manner illustrated in FIG. 9, the sheet being fed printed surface down to longitudinally arranged cutting station 188 at which successive strips 190 of four labels each are cut off of the end of sheet 182. A segmental drive roller 192 incrementally feeds individual label lengths of each label strip 190 to the left as viewed in FIGS. 9, 10, 11 and 15, to a rotary knife 194 that cuts the individual labels off of the left end of the label strip 190 and dispenses the labels sequentially onto the arcuate head 196 of a heated vacuum wheel 198 upon each cycle thereof. A heat activated adhesive is provided on the unprinted surface of each label and is activated as the label is transported from the rotary knife 194 to a magazine 184. The vacuum wheel 198 thus plasters a separate label on each successive magazine moving along the conveyor 186.

OPTICAL READER AND SHIFT REGISTRATION

Shift registration for shifting from zip code to zip code in the stacker 10 is done with an optical reader 200 on the labeling machine 180, which provides a shift signal to the stacking machine 10 so as to instantaneously shift the separator or diverter 34, and then after a short delay for allowing completion of a feed cycle to the respective hopper 40 or 42, shifting the respective side of the lower stacking station 30. According to conventional practice, such shift registration by taking a reading of the labeling machine requires that the signal which is read at the labeling machine be delayed the entire length of time for the corresponding label and its associated magazine to be fed to the stacker, and with one type of conventional prior art equipment, this involves a two-label magazine cycle delay in the signal before its operational application, while in another type of conventional prior art equipment this involves about a 40-label magazine cycle delay of the signal before its application. This conventional practice requiring an extended time delay in the shift signal between its reading and its application introduces undesirable complexities into the apparatus, with a corresponding reduction in reliability.

Figures 9, 10, 11, 12:
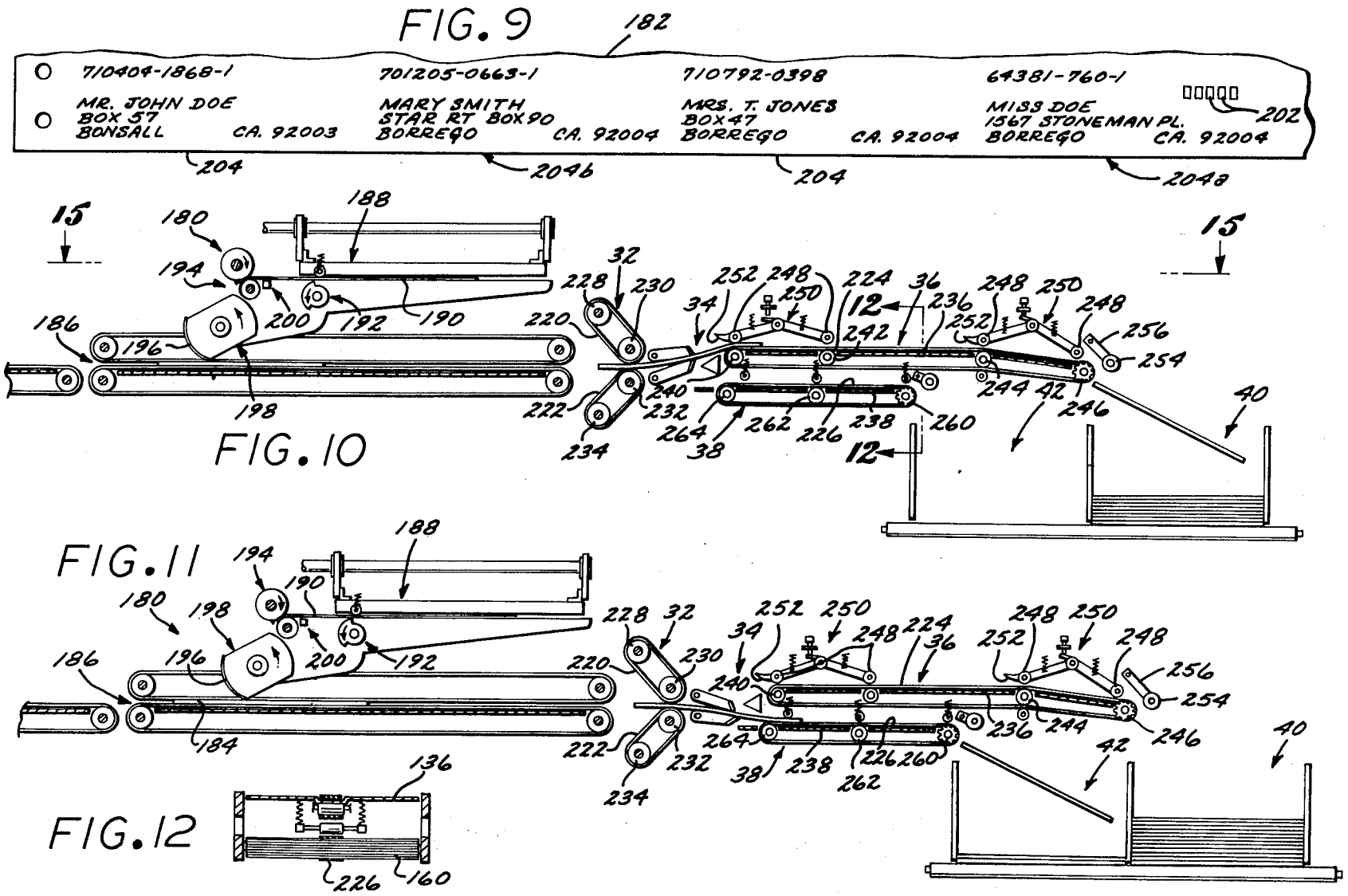
FIG. 9 is a fragmentary plan view of a computer printout sheet bearing a strip of labels and illustrating the indexing relationship between a label bearing a zip code change and another label two labels behind it in the line bearing the shift registration marks.
FIG. 10 is a diagrammatic vertical axial section, with parts broken away and portions shown in elevation, illustrating an in-line combination of a labeling machine and stacking apparatus according to the invention, and particularly illustrating the cooperative relationship between the optical reading station on the labeler and the upper feed station of the stacker, FIG. 10 illustrating the upper feed station in its upper feed mode wherein the separator or diverter is in its up position feeding the upper feed conveyor to dispense magazines in the right-hand hopper or bin.
FIG. 11 is a view similar to FIG. 10, but illustrating the upper feed station in its lower feed mode, wherein the separator or diverter is in its down position feeding magazines to the lower conveyor, which in turn feeds the magazines into the left-hand hopper or bin of the stacking station.
FIG. 12 is a fragmentary vertical section showing some details of the upper feed station.

In contrast to such conventional prior art shift registration, the shift registration according to the present invention is provided in the main computer printout sheet as illustrated on the printout sheet 182 seen in FIG. 9. The optical reader 200 reads a closely spaced, longitudinally arranged series of five rectangular black dots 202 associated with a label, only one of which dots is actually required for a reading, but five of which are provided for redundancy to be sure that a zip code change is not missed. The main computer accomplishes the shift registration by providing the shift registration dots or marks 202 in connection with a label 204*a* that is two labels back from the label 204*b* representing the actual zip code change. Thus, the first label 204*b* and its magazine, representing a zip code change required to be diverted to a new stack in the stacker 10, is just entering the stacker 10 when the shfit registration dots 202 on the label 204*a* still upstream in the line registers with the optical reader 200. As a practical matter, it is desirable to have this optical reading of the shift registration marks 202 on the label 204*a* two labels back occur when the leading edge of the magazine bearing the new zip code label 204*b* is within a range of about 6 to 10 inches ahead of the separation point as defined by the separator or diverter 34.

By thus reading a label back upstream, instead of reading the acutal zip code change label, the conventional use of either an electromechanical delay mechanism or a minicomputer type delay mechanism is avoided in the application of the shift registration signal to the separator 34, making the present apparatus substantially simpler, more economical and more reliable than prior art apparatus of this general type.

The relative positioning of the optical reader 200 on the labeling machine 180 is illustrated in FIGS. 10 and 11, while the specific relationship of the optical reader relative to a label strip 190 and an individual label 204 is illustrated in FIGS. 16 and 17. Th preferred position for the optical reader 200 on the labeling machine 180 is in advance of the rotary knife 194, so that the reading can be taken while the label 204 still has the stability of its integral relationship with the label strip 190.

A presently preferred type of optical reader is of the light source and reflective sensor type, such as a Fairchild optical reader. As illustrated in FIG. 16, this type of optical reader includes a light beam source 206 laterally offset from the light sensor 208 for normally providing a reflective light beam 210 to the sensor 208 by reflection off of the white paper of the label strip 190. However, when one of the black registration marks 202 registers with the light beam 210 it interrupts the beam so that the optical reader 200 will generate the shift signal. It will be seen that if one or more of the black registration dots 202 on a particular label should be imperfect from poor computer printing, the close-spaced sequence of five of the dots 202 assures a reliable optical reading thereof.

Reliability of the present optical reading system is further assured by the use of the reflective sensor and light source type of optical reader 200 wherein the sensor 208 is much smaller than one of the registration marks 202, on the order of only 1/20th the size. This is in contrast to prior art optical reading equipment wherein the light source applied the light through the paper, and the optical aperture was much larger than the dot, whereby reading was performed on a balance threshhold basis that was not a positive go-no-go read-out as with the present system.

To assure that the label strip 190 will track accurately relative to the optical reader 200, both laterally and in vertical spacing, a label strip guide 212 is provided in conjunction with the optical reader 200. The optical reader 200 is recessed about 0.050 inch below the flat upper surface 214 of guide 212 to provide the desired reflection geometry, and the label strip 190 is laterally confined between a pair of side flanges 216 on the guide 212. A transverse line of vacuum holes 218 entends across the surface 214 of guide 212 so as to positively hold the label strip 190 flush against surface 214 at the correct vertical spacing from reader 200. The vacuum hole line 218 is pneumatically connected to the vacuum system of the labeling machine used in connection with the vacuum wheel 198.

THE UPPER FEEDER STATION

Referring now to the upper feed station 28, the input feeder 32 thereof includes a pair of opposed, inclined feeder belts 220 and 222 that are preferably positively driven cog belts that are driven at a linear speed substantially less than that of the conveyor 186 of the labeler so as to slow down the speed of the magazines to a minimum separation speed in the upper feed station 28. Thus, while approximately 20 inches lineal span is provided per each 11-inch magazine in the labeler 180, the input feeder belts 220 and 222 slow the magazines down to a linear span of only about 13 inches per 11-inch magazine, so that there will only be approximately a 2-inch space between successive magazines. Positively driven upper and lower conveyor cog belts 224 and 226 of the respective upper and lower conveyors 36 and 38 are continuously driven at the same lineal speeds as the continuously driven feeder belts 220 and 222, so as to preserve this minimum separation between the magazines throughout their passage through the upper feed station 28. This minimizes the rate of speed at which the magazines are ejected from the respective upper and lower conveyors 36 and 38 into the respective hoppers 40 and 42, so as to minimize bounce and assure positive stacking in the respective hoppers. Positive gripping of the magazines between feeder belts 220 and 222 is provided by having the upper feed belt 220 driven off of its upper pulley 228, permitting the lower pulley 230 thereof to shift about the axis of upper pulley 228, being biased downwardly to provide the gripping engagement. The upper and lower pulleys 232 and 234 of the lower feeder belt 222 may then both be on fixed axes.

The upper and lower conveyors 36 and 38 include respective slides 236 and 238 over which the magazines move, each slide having a laterally centered trough or depression running along its length within which the respective conveyor belts 224 and 226 ride.

THE UPPER CONVEYOR

The upper conveyor belt 224 is positively cog driven by a pulley 240 at its upstream end, being guided over a pair of intermediate idler pulleys 242 and 244, and at its downstream end extending over and driving a splined kick-down roller 246 which serves to kick the rear end edges of the magazines positively down into the hopper 40. The magazines are biased downwardly into driving engagement with the upper conveyor belt 224 by a series of four idler rollers 248 mounted on two pivoted arm assemblies 250 wherein the arms are biased downwardly, and wherein the leading arm of each has a lead-in guide surface 252 for the magazines.

A pair of laterally spaced flip-down rollers 254 are supported on respective arms 256 downstream of the kick-down roller 246 and with the bottom surfaces of rollers 254 disposed below the line of moving magazines coming off of the upper conveyor 36 so as to positively tilt the leading edges of the magazines downwardly into the bin 40. The flip-down rollers 254 and arms 256 are diagrammed in FIGS. 10 and 11, and shown in some structural detail in FIGS. 1 and 2, the arms being supported on a transverse shaft 258 that is tiltably adjustable for adjusting the vertical positioning of rollers 254 to provide optional directional control in feeding the magazines in the hopper 40.

THE LOWER CONVEYOR

The lower conveyor belt 226 is driven off of its cogged downstream support roller 260, which is a splined kick-down roller similar to and serving the same function as the upper kick-down roller 246, but relative to the left-hand hopper 42. The lower conveyor belt 226 extends upstream from roller 260 over idler rollers 262 and 264. The purpose in driving the lower conveyor belt 226 off of its downstream roller 260 is to permit the entire lower conveyor assembly 38 to be selectively tilted downwardly or anticlockwise about the pivot axis of roller 260 so as to open up the assembly for access in case of a jam.

The lower conveyor 38 also includes a pair of laterally spaced, vertically adjustable flip-down rollers 266, the bottoms of which are disposed somewhat below the line of movement of the magazines so as to positively tilt the leading edges of the magazines down into the hopper 42, the kick-down roller 260 then kicking the rear ends of the magazines positively down into the hopper 42, for reliable stacking of the magazines.

THE SEPARATOR OR DIVERTER

The separator or diverter generally designated 34 includes a pair of cooperating vertically shiftable fingers 268 and 270 between which the magazines are guided to either the upper conveyor 36 or the lower conveyer 38 according to whether the fingers are in their upper or lower positions. The fingers 268 and 270 are individually pivotally mounted for their vertical shifting movements, but the pivotal mountings are operatively connected for coordination. In this manner, as best seen by a comparison between the upper position illustrated in FIG. 10 and the lower position illustrated in FIG. 11, the vertical shifting movements thereof are accompanied by relative longitudinal movements in the direction of flow of the magazines, wherein in the lower position the lower finger 270 is offset downstream from the upper finger 268 as a guide against the magazines being diverted too far downwardly, while in the upper position in which the weight of the magazines will tend to hold them down the fingers 268 and 260 are closely adjacent in the direction of flow of the magazines.

This pivotal supporting for the fingers 268 and 270 includes a pair of support arms 272 for the upper finger 268 and a pair of support arms 274 for the lower finger 270. The upper and lower arms 272 and 274 are supported on respective parallel, horizontal shafts 276 and 278 which are tranverse to the direction of flow of the magazines. The shafts 276 and 278 are mechanically coordinated for synchronous pivoting by connecting chain and sprocket assembly 280.

The magazines are traveling through the separator or diverter 34 at a high rate of linear speed. Thus, assuming that the labeling machine 180 will cycle the magazines at a rate of from about 20,000 to about 27,000 per hour, the linear speed with a span of about 13 inches per magazine will range from about 360 feet to about 490 feet per minute. This requires positive, instantaneous vertical shifting in both directions of the fingers 268 and 270, and it also requires minimization of the opposing effects of inertia by limiting the vertical shifting of the fingers to the shortest possible stroke. These objectives are accomplished by several additional features in the separator 34 as best illustrated in FIGS. 13 and 14. Thus, vertical shifting movement of the fingers is applied by separate pull-in solenoids 282 and 284 connected to opposite ends of a rocker arm 286 drivingly secured to the lower pivotal shaft 278, which in turn is drivingly connected to the upper shaft 276 through chain and sprocket assembly 280. Thus, the upward shifting movement of the fingers 268 and 270 is positively effected by energization of pull-in solenoid 282; while downward shifting movement of the fingers is effected by energization of pull-in solenoid 284.

It has been found in prototype apparatus according to the invention that if the magazines are directed simply by vertical shifting movements of the fingers 268 and 270 without further apparatus, the stroke length for such vertical shifting would have to be on the order of 1½ inches, which would introduce unduly high inertial loads because of the rapidity of the shift that is required. This stroke length is reduced down to only approximately ¼ inch by introduction of a divider blade 288 having a sharply pointed upstream end edge 290 immediately downstream of the fingers 268 and 270, with an upwardly inclining upper surface 292 arranged to receive the magazines from the fingers in the upper positions of the fingers and guide the magazines into the upper conveyor 36; the divider blade 288 having a downwardly inclining lower surface 294 adapted to receive the magazines in the downward position of the fingers and guide the magazines into the lower conveyor 38.

UPPER FEED STATION DRIVE

Figure 8:
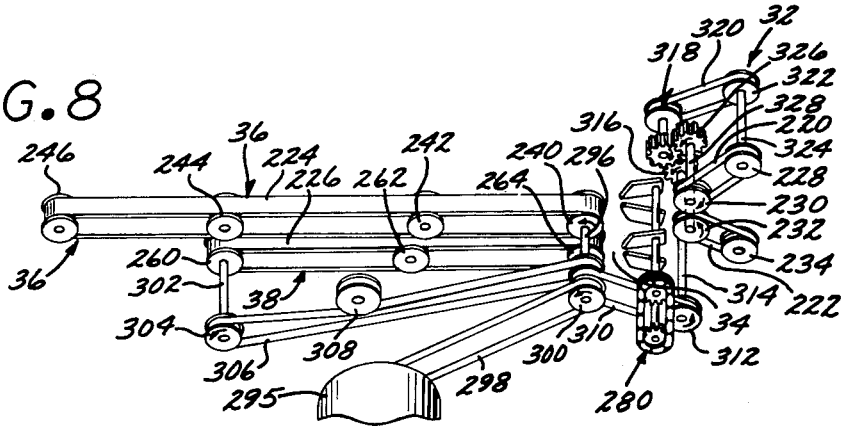
FIG. 8 is a diagrammatic perspective view, taken from the rear of the apparatus, illustrating the drive connections to the upper feed station of the stacker.

FIG. 8 diagrammatically illustrates the driving connections for the upper feed station 28, looking from the rear of the apparatus so that the motions will be reversed from those as illustrated in FIGS. 10 and 11. An electric motor 295 provides a continuous rotary source of power to primary drive shaft 296 through a cog belt 298 and a pulley 300 keyed to shaft 296. The continuous rotary movement of shaft 296 is anticlockwise as viewed in FIG. 8. The drive pulley 240 for upper conveyor belt 224 is keyed on the primary shaft 296 for its anticlockwise rotary movement. The drive roller 260 for lower conveyor belt 226 is mounted on a shaft 302 having a pulley 304 thereon that is driven from primary drive shaft 296 by means of cog belt 306 having tensioning idler 308 engaged therewith. It will be seen that this arrangement drives lower conveyor roller 260, which is a kick-down roller for the lower conveyor, anticlockwise.

Although the upper and lower flip-down rollers 254 and 266, respectively, are illustrated in the drawings as idler rollers, it is contemplated that improved performance may be provided by driving these flip-down rollers. In such event, since their lower surfaces are the operative ones, they must be driven in an opposite direction of rotation from the respective kick-down rollers 246 and 260. These flip down rollers 254 and 266 may be driven off of the lower conveyor drive shaft 302 by suitable reversing drive means (not shown).

Motive power for driving the feeder belts 220 and 222 is also supplied from primary drive shaft 296, by way of a cog belt 310 which drives a pulley 312 keyed on a shaft 314 anticlockwise. The shaft 314 has an output gear 316 thereon which drives a gear and pulley combination 318 clockwise, which in turn, through belt 320, pulley 322, and shaft 324 drives the upper pulley 228 of upper feeder belt 220 clockwise.

The gear of gear and pulley combination 318 also drives a gear 326 and its shaft 328 anticlockwise, the upper pulley 232 of lower feeder belt 222 being mounted on this shaft 328 for anticlockwise rotation.

CYCLING RATES AND LINEAR SPEEDS

A currently available basic labeling machine, such as a Xerox Cheshire 528 labeler, has a maximum operating rate of approximately 27,000 cycles per hour, and it is desirable to operate the labeling machine at a rate of at least about 20,000 cycles per hour so as to accommodate a pair of stitching machines upstream, the outputs of which are merged for introduction into the labeler. Stitching machines as currently constructed are capable of netting an individual output of about 10,000 magazines per hour. Thus, a presently preferred operating rate for the present stacking machine 10 is from about 20,000 to about 27,000 magazine handlings per hour, which corresponds to from about 555 to about 750 magazines per minute.

At this rate, allowing approximately a 13-inch span per magazine in the flow thereof through the upper feed station 28 of the present apparatus, the rate of movement of the magazines through the upper feed station 28 will be from about 360 to about 490 feet per minute. It is to be understood, however, that this may be increased as desired to accommodate larger magazines or other flat objects, or to provide increased space between the successive magazines or other objects.

Current post office requirements for zip coded bundles specify that the bundles contain no less than six and no more than 25 magazines or the like. It is for this reason that the present adaptation of the invention for zip code stacking contemplates minimum stacks of six magazines or the like to be deposited in the hoppers 40 and 42, corresponding to a 50% overlap of the right and left sides of the lower stacking station 30. So as to be able to accommodate such minimum stacks of six magazines when they may occur in the zip code stacking, for the aforesaid range of magazine handlings of between 20,000 and 27,000 per hour, and providing a 10-inch span for each stack of magazines, the surface speeds of the live rollers 44 will range from about 46 feet per minute to about 62 feet per minute.

With the merging units 56 and 58 inclined at approximately 45° relative to the output axis of the stacker 10, they must travel 1.414 times the speed of the live rollers 44, or from about 65 feet to about 88 feet per minute.

DAMPENER

In order to provide good adhesion against horizontal shifting between magazines in the stacks that are formed, perticularly because of such rapid handling of the stacks, it is desirable to apply a fine air and water spray to the tops of the magazines as they enter the stacker 10. As seen in FIGS. 1 and 2, a spray head 330 is supplied with the air and water through suitable conduits 332 and 334. The dampness provided to the magazines will have completely evaporated by the time the stacks of magazines arrive at a bundle tying station downstream of the stacker 10.

ELECTRICAL LOGIC

Figure 18:
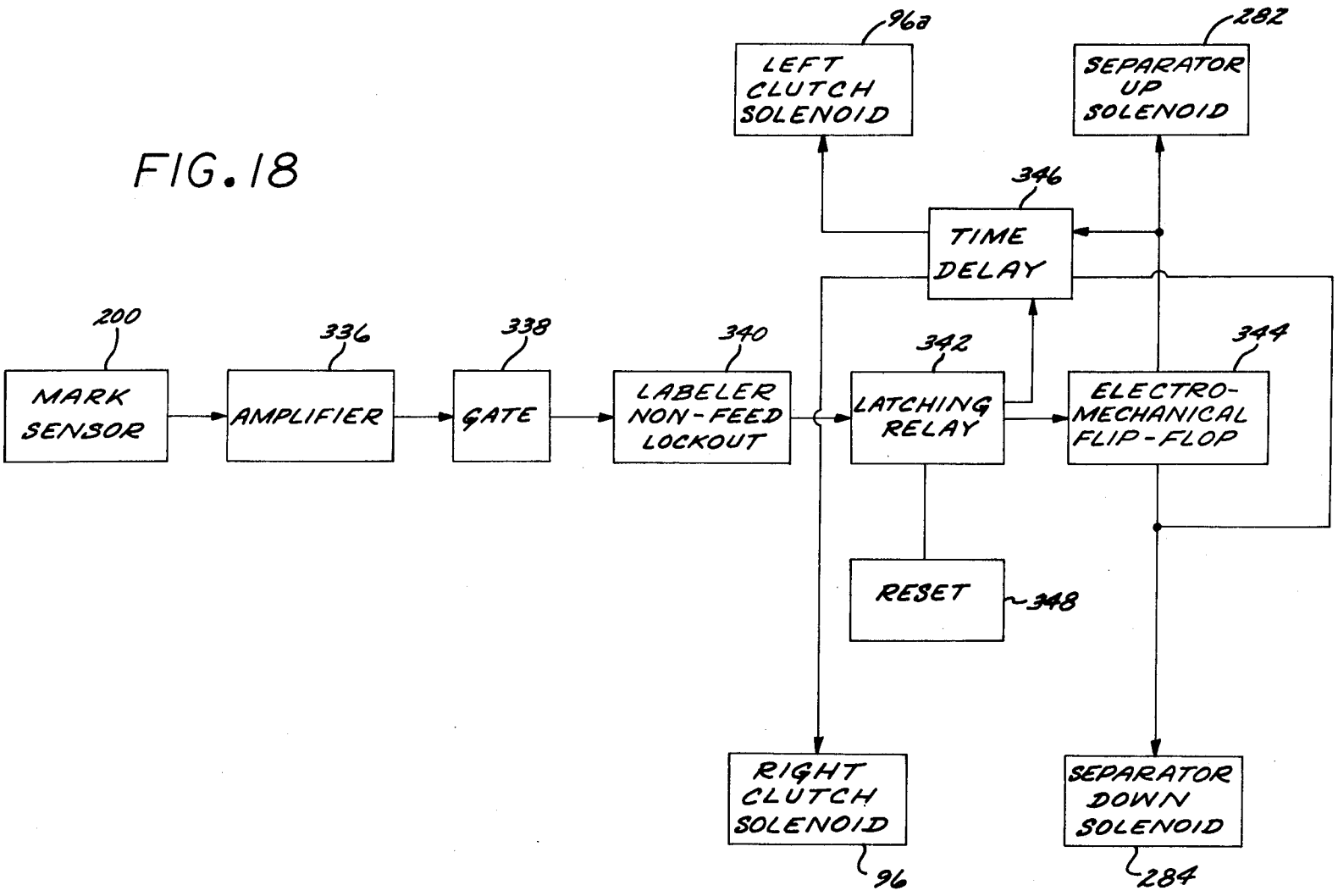
FIG. 18 is an electrical logic flow chart for the present invention.

FIG. 18 is an electrical logic flow chart diagrammatically illustrating the electrical intelligence for the stacking apparatus 10. The flow chart starts at the left with a mark sensor, which is the optical reader 200 on the labeling machine 180 for reading a shift registration mark 202 on a label. The output signal from mark sensor 200 is amplified in an amplifier 336 forming a part of the electronic apparatus of the stacker 10, and is passed by a gate 338 associated with the labeling machine 180. This gate 338 constitutes switching means operatively connected to the main head drive shaft on the labeling machine 180 from which the vacuum wheel 198 is driven, and is for the purpose of reducing the chance for stray signals to energize the stacker 10.

After the signal originating at mark sensor 200 has passed through gate 338 it then passes through a nonfeed lockout 340, which is relay means normally closed if magazines are feeding through the labeling machine 180, but connected in parallel with the nonfeed lockout solenoid of the labeling machine 180 so as to open and break the sensing circuit to the stacker 10 upon actuation of the labeler nonfeed lockout to temporarily stop the feeding of magazines.

The signal is then applied to a latching relay 342, the closing of which simultaneously energizes an electromechanical flip-flop 344 and a time delay 346. The electromechanical flip-flop 344 upon actuation instantaneously applies a signal to either the separator up solenoid 282 or the separator down solenoid 284, together with a direction signal to the time delay 346.

Assuming that the particular signal from mark sensor 200 which is applied through latching relay 342 to the electromechanical flip-flop 344 causes the flip-flop 344 to energize the separator up solenoid 282, this will instantaneously flip the separator or diverter 34 to its up position so as to start feeding magazines to the right-hand hopper 40. At the same instant the time delay 346 is started, and the signal from flip-flop 344 to the up solenoid 282 directs the time delay 346 to apply its signal to left clutch solenoid **96*a*. The time delay of about 27 to 29 milliseconds allows the feeding of left-hand hopper 42 to be completed by the time the time delay 346 energizes left clutch solenoid 96*a* so as to cycle the left-hand side of the lower stacking station 30**.

The electromechanical flip-flop 344 is a mechanical relay type of flip-flop, rather than an entirely electronic type flip-flop, in order to minimize the effects of spurious signal spikes of the type likely to be encountered in an industrial printing complex.

The latching relay 342 is prepared for another cycle of operation by reset 348 which is a cam operated microswitch associated with the same shaft on the labeling machine as the gate 338.

The electromechanical flip-flop 344 is arranged so that each time it receives a signal from latching relay 342 it flips to the opposite mode of both the upper feed station 28 and the lower stacking station 30. Thus, the next signal from mark sensor 200 will, upon actuating the latching relay 342, cause the flip-flop 344 to actuate the separator down solenoid 284, the time delay again being started by the latching relay, and the signal from flip-flop 344 to down solenoid 284 directing the time delay to energize the right clutch solenoid 96 after the delay time has passed to enable the completion of the feeding of magazines to the right-hand hopper 40.

Although the electromechanical type of flip-flop 344 is preferred for the reasons stated above, it will be apparent that in some environments a completely electronic solid state type flip-flop may be employed. A suitable type of electromechanical flip-flop is a ratchet type relay.

SHIFT REGISTRATION SIGNAL DEVELOPMENT CIRCUITRY

Figure 19:
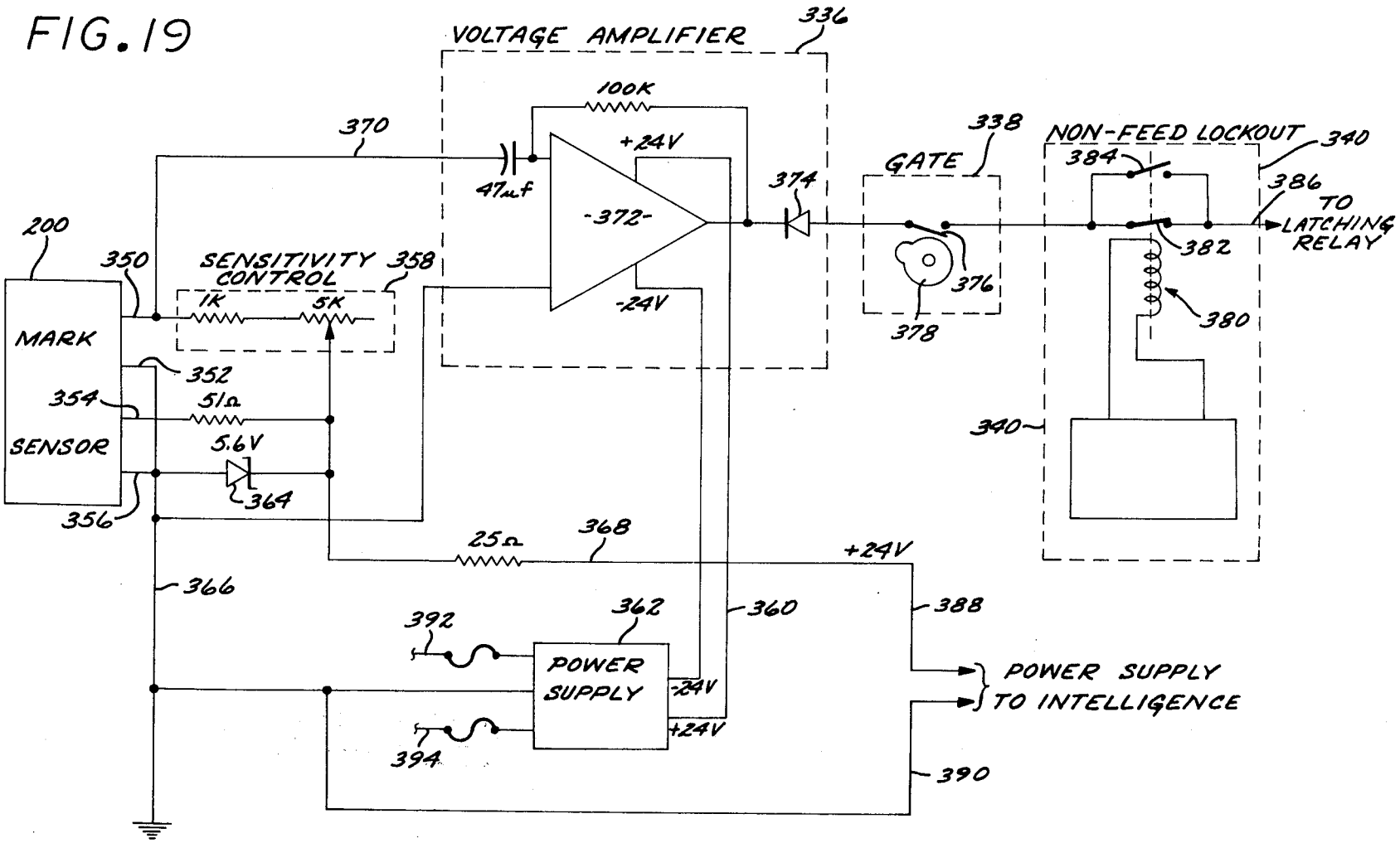
FIG. 19 isa circuit diagram illustrating the circuitry associated with the optical reader or mark sensor for providing an amplified and gated signal to the stacker intelligence.

FIG. 19 diagrammatically illustrates the circuit arrangement relating to the mark sensor 200, the amplifier 336, the gate 338, and the nonfeed lockout 340.

The mark sensor 200 is a semiconductor device including a light emitting diode (LED) and a phototransistor, arranged together in one assembly so that the light from the diode reflects off of the magazine label back into the phototransistor for sensing. Conductors 350 and 352 are connected to the phototransistor portion of sensor 200, while conductors 354 and 356 are connected to the LED portion of sensor 200. A sensitivity control 358 consists of variable resistor means connected between the phototransistor signal output conductor 350 and the positive power supply output line 360 of power supply 362. The voltage to the LED portion of mark sensor 200 is limited to 5.6 volts by the Zener diode 364 connected between ground line 366 and the positive line 368. The signal output of the mark sensor at conductor 350 is only about 5 volts, and this is fed through conductor 370 to the voltage amplifier 336 so as to raise the voltage of the signal from mark sensor 200 to a level usable by the remainder of the circuit. The voltage amplifier 336 embodies an operational amplifier 372 as its principal component, the output therefrom being fed to gate 338 through a diode 374 to assure that the output of the voltage amplifier 336 is of negative polarity.

The gate 338 includes a normally open microswitch 376 that is adapted to be momentarily closed by cam 378 associated with the main head drive shaft of the labeling machine 180. The switch 376 is closed by cam 378 only during the part of the cycle when it is possible for the mark sensor 200 to sense a zip code mark; i.e., during that part of a label movement across the mark sensor 200 when the five shift registration marks 202 come into registry with the sensor 200.

The signal is then fed from gate 338 to the nonfeed lockout 340, which includes a relay 380 having a normally closed contact 382 wired in parallel with the head lockout solenoid of the labeling machine 180. Relay 380 is adapted to release, and thereby allow contact 382 to open, if the labeler shuttle feed should fail to feed a magazine. Thus, the output circuit from voltage amplifier 336 is broken when magazines are not feeding out of the labeler, so as to prevent a false signal from the voltage amplifier 336 from actuating the mechanisms of the stacker 10. A normally open override contact 384 is disposed in parallel with the relay contact 382 for testing in case the relay should fail. The amplified, selected signal is then fed from the nonfeed lockout 340 through a conductor 386 to latching relay 342 diagrammed in detail in FIG. 20.

Power for energizing the latching relay 342, the electromechanical flip-flop 344, the separator up and down solenoids 282 and 284, respectively, the time delay 346, and the right and left clutch solenoids 96 and 96*a,* respectively, is supplied from the power supply unit 362. Power supply 362 provides 24 volt D.C. power though respective positive and ground conductors 388 and 390; and also provides 110 volt A.C. power through conductors 392 and 394.

DETAILED STACKER INTELLIGENCE CIRCUITRY

Figure 20:
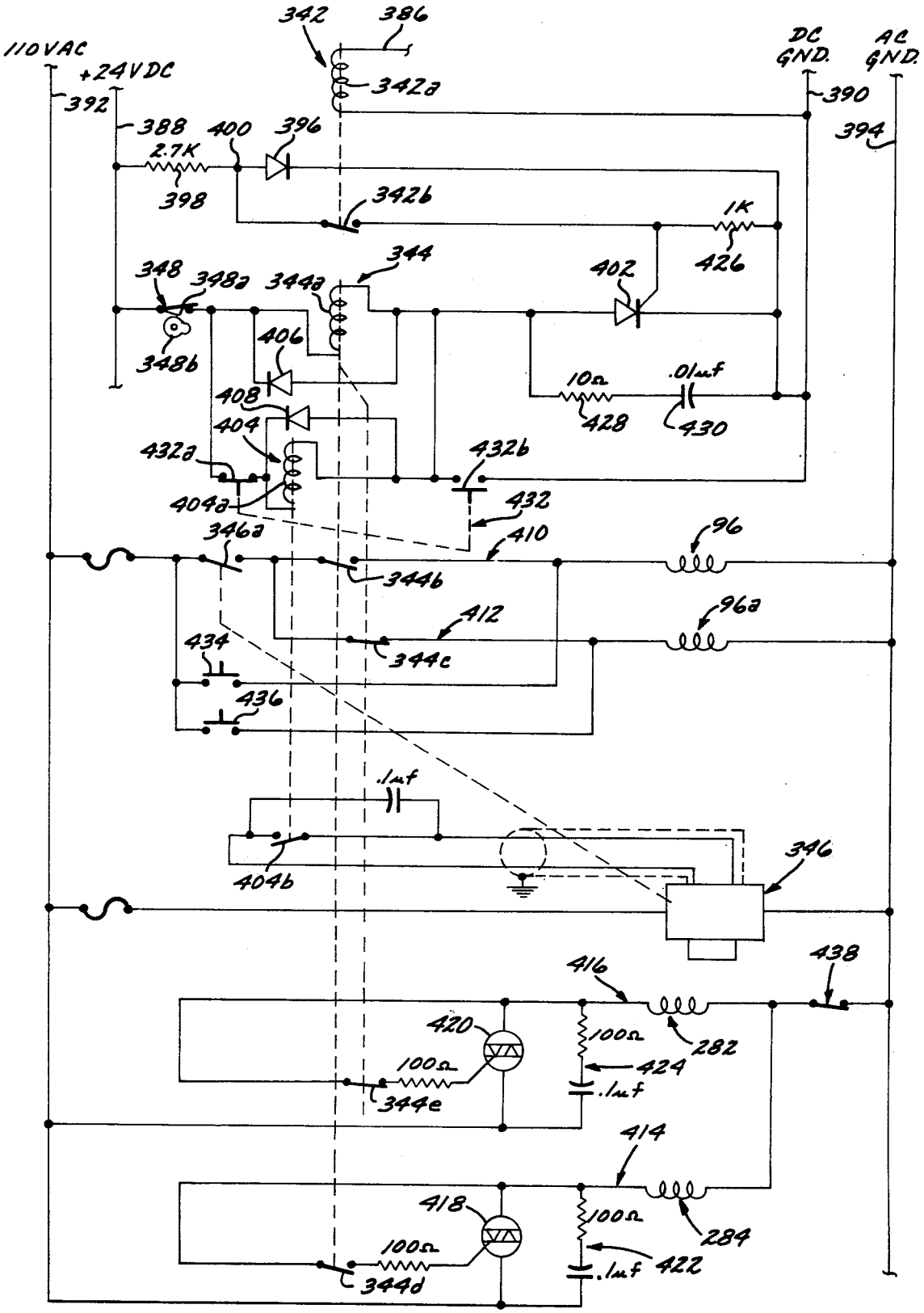
FIG. 20 is a circuit diagram of the stacker intelligence.

Reference will now be made to FIG. 20, which diagrammatically details the intelligence of stacker 10. Coming in at the top of this diagram are the signal input conductor 386, the D.C. conductors 388 and 390, as well as the A.C. conductors 392 and 394. The amplified signal is fed from conductor 386 to the coil 342*a* of latching relay 342, so as to close the relay contact 342*b.* Latching relay 342 is preferably a Reed relay. Diode 396 and resistor 398 define a 1.25 volt source at connection 400 which turns on SCR (silicon controlled rectifier) 402. The SCR 402 is employed because the Reed relay contact 342*b* has insufficient capacity to take the current surge required to operate the electromechanical flip-flop 344. Nevertheless, a Reed relay is desirable for the latching relay 342 in order to provide a high degree of sensitivity to the short duration pulse applied thereto through conductor 386, which is on the order of about 10 milliseconds.

When SCR 402 thus turns on, it provides a D.C. current path between D.C. conductors 388 and 390 through the coil 344*a* of electromechanical flip-flop 344, and through the normally closed contacts 348*a* of reset switch 348. Arranged in parallel with the flip-flop coil 344*a* is the coil 404*a* of a time delay trigger relay 404; whereby when the SCR 402 turns on, there will be a simultaneous sequencing of flip-flop 344 and actuation of time delay trigger relay 404. Protective diodes 406 and 408 bridge the respective relay coils 344*a* and 404*a* to prevent current reversing, especially with respect to the spikes that may occur upon de-energization of the coils, which otherwise tend to interface with the operation of the time delay 346.

The reset switch 348 is a cam operated microswitch, having the normally closed contact 348*a* adapted to be momentarily opened by cam 348*b* mounted on the labeler 180 so as to unlatch the SCR 402 after the flip-flop 344 and time delay trigger relay 404 have been actuated.

The flip-flop 344 is a sequence relay that switches from one set of normally closed or open contacts to another set of normallly closed or open contacts each time its coil 344*a* is energized.

Each time the normally open time delay trigger relay contact 404*b* is closed by energization of time delay trigger coil 404*a,* the time sequence of time delay unit 346 begins. The time delay sequence is on the order of about 27 to 29 milliseconds, at the end of which the time delay 346 closes a normally open time delay contact 346*a,* which closes an A.C. path from A.C. conductors 392 and 394 to a pair of parallel single revolution clutch solenoid circuits 410 and 412, the circuit 410 including right single revolution clutch solenoid 96, and the circuit 412 including left single revolution clutch solenoid 96*a.* However, closure of time delay contact 346*a* will only energize one of the clutches 96 and 96*a,* according to the sequence position of the flip-flop 344, because flip-flop relay contacts 344*b* and 344*c* are disposed in the respective circuits 410 and 412, and when one of these flip-flop contacts 344*b* and 344*c* is open, the other will be closed, and each time the flip-flop 344 sequences, these contact positions will be reversed. In FIG. 20 the flip-flop relay contact 344*b* in right clutch circuit 410 is in the open position, while flip-flop contact 344*c* in left clutch circut 412 is shown closed. Thus, after the time delay, when time delay contact 346*a* closes, with the flip-flop 344 in the position illustrated in FIG. 20, current will be provided to energize the left single revolution clutch solenoid 96*a.*

The electromechanical flip-flop 344 has two further contacts 344*d* and 344*e* associated with respective separator circuits 414 and 416 in which the respective separator down solenoid 284 and separator up solenoid 282 are located. The separator down and up solenoid circuits 414 and 416 are arranged in parallel across the A.C. conductors 392 and 394, and include in their paths respective triacs (alternating current SCR's) 418 and 420. Closure of flip-flop relay contact 344*d* will trigger the separator down circuit triac 418, while closure of the flip-flop contact 344*e* will trigger the separator up circuit triac 420; on the other hand, opening of the respective flip-flop relay contacts 344*d* and 344*e* will turn off the respective triacs 418 and 420. The triacs 418 and 420 have respective stabilization circuits 422 and 424 extending across them, these stabilization circuits assuring positive turn off of the triacs.

In the position of flip-flop 344 illustrated in FIG. 20, wherein flip-flop contact 344*c* is closed so as to actate the left clutch solenoid 96*a* at the end of the time delay, the flip-flop contact 344*e* is closed, so that triac 420 is fired and up separator circuit 416 is closed for energization of the separator up solenoid 382. At this time, the flip-flop contact 344*d* is open, so that the separator down solenoid circuit 414 is open. Upon the next sequencing of the flip-flop relay 344, the conditions will be reversed in the separator circuits 414 and 416 to energize the separator down solenoid 284 and de-energize the separator up solenoid 282.

Further circuit components shown in FIG. 20 include resistors 426 and 428 and capacitor 430 which cooperate in stabilization of the SCR 402; manual separator switch 432 adapted for testing the separator solenoids 282 and 284; and manual clutch switches 434 and 436 for manually test-actuating the respective right and left single revolution clutch solenoids 96 and 96*a.*

The manual separator switch 432 includes a normally closed contact 432*a* and a normally open contact 432*b.* Actuation of the manual separator switch 432 opens its contact 432*a* so as to take the time delay trigger relay 404 out of the circuit and prevent the time delay 346 from activating the single revolution clutches 96 and 96*a;* while such actuation of switch 432 closes its contacts 432*b* so as to energize the flip-flop 344 and thereby cycle the separator solenoid circuits 414 and 416 so as to test the respective separator solenoids 284 and 282.

The circuit illustrated in FIG. 20 additionally includes a normally open relay 438 in the separator solenoid circuits 414 and 416, which is operatively connected to the motor 295 that drives the upper feed station 28 as shown in FIG. 8, the relay 438 closing after the motor 295 is turned on so as to prevent a turn-on generated spike from inadvertently actuating clutch due to the sensitivity of the triacs 418 and 420.

The various controls described hereinabove in connection with FIG. 20 and with the other figures are located on a control panel 440 extending outwardly from the rearwardly inclining housing walls 20 as illustrated in FIGS. 1 and 2.

SUMMARY OF THE INVENTION

Summarizing the automatic operation of the stacker intelligence illustrated in FIG. 20, an input signal to the intelligence at conductor 386, derived at mark sensor 200 and amplifed in voltage amplifier 336, energizes coil 342*a* to close contact 342*b* of latching relay 342 and threby turn on the SCR 402. Current through SCR 402 energizes coil 344*a* of flip-flop 344 so as to advance the flip-flop relay to a new sequence. Assuming that the four contacts of flip-flop relay 344 are in the positions illustrated in FIG. 20, namely, contacts 344*c* and 344*e* being closed, while contacts 344*b* and 344*d* are open, then such sequencing will reverse the positions of all of these relay contacts so as to close contacts 344*b* and 344*d* and to open contacts 344*c* and 344*e.*

Such sequencing wil by this means simultaneously shut off triac 420 to release separator up solenoid 282 and turn on triac 418 to energize separator down solenoid 284, so as to shift the separator to its down position; and release left clutch solenoid 96*a* and prepare the circuit 410 for energization of right clutch solenoid 96 when the circuit is subsequently engaged by the time delay 346. Simultaneously with such energization of the flip-flop relay 344 and aforesaid resulting functions, at the instant SCR 402 turns on it will energize the coil 404*a* of time delay trigger relay 404 so as to close the trigger relay contact 404*b* and thereby start the time cycle of time delay 346, during which time cycle the magazines or the like are allowed to complete their feed cycle along upper conveyor 36 to right-hand hopper 40. At the end of the time delay the time delay unit 346 will close its relay contact 346*a* so as to complete the connection through circuit 410 to the right single revolution clutch solenoid 96 so as to cycle the right-hand part of the lower stacking station 30.

The next sequencing of flip-flop relay 344 will return its contacts 344*b, c, d* and *e* to the positions illustrated in FIG. 20, will again simultaneously energize the time delay trigger relay 404 to start another time delay interval in the time delay unit 346, and the resulting functions will be a shifting of the separator 34 back to its position and then at the completion of the time delay a cycling of the left-hand part of the lower stacking station 30.

CIRCUIT COMPONENTS

Although the present invention is not in any way limited to the use of particular electronic or electromechanical components, the following components have been found to be suitable in a prototype of the invention: Optical reader or mark sensor 200: Fairchild light reflection transducer; Fairchild Part No. FLPA850A or FPA104; obtainable from G. S. Marshall, El Monte, Ca., and from Hamilton Electro Sales, Culver City, Ca. Time delay relay 346: delay on operate, normally open, automatic reset Eagle Signal Model No. CT540A602; obtainable from the Hundley Company, Los Angeles, Ca. Variable resistor in sensitivity control 358: 5K, 2 watt potentiometer; linear taper. 25 ohm resistor in line 368: 25 watt wirewound resistor Power supply 362: +/− 24 volt power supply; obtainable from Op-Amp Labs, Los Angeles, Ca. Operational amplifier 372 in the voltage amplifier 336: Operational amplifier Model b 440R; Op-Amp Labs, Los Angeles, Ca. Triacs 418 and 420: General Electric SC50D; obtainable from Kierulff Electronics, Commerce (Los Angeles), Ca. Other circuit components have values indicated on the drawings, and are readily available.

While the instant invention has been shown and described herein in what is conceived to be the most practical and preferred embodiment, it is recognized that departures may be made therefrom within the scope of the invention.

I claim:

1. The method of diverting labeled objects moving rapidly in succession in a continuous stream to form a plurality of streams for stacking purposes, comprising employing an electrical shift signal from the sensing of indicia upon predetermined labels to divert said objects selectively to one of said plurality of streams, and locating the label a fixed number of labels behind the label in line to be first diverted by the corresponding shift.

2. The method of claim 1 and directing said labeled objects into respective first and second stacks of said objects at respective first and second stacks of said objects at respective first and second stacking stations one beyond the other on approximately the same level, removing each stack laterally from its respective station onto an output conveyor before completion of the next successive stack at the other station so as to make each station open for the commencement of a new stack, and merging said stacks being alternately removed from said stations successively onto a single output conveyor with a predetermined overlap of the merging cycles while a new stacking sequence is occurring at one of the stations.

3. The method of claim 1 comprising directing said labeled objects into first and second stacks of said objects at first and second stacking stations, removing a completed stack from one of said stations before completion of the stack at the other station, and employing said electrical shift signal to initiate said removal upon diverting of said stream to said other stacking station by said signal.

4. The method of claim 3, wherein each of said shift signals is delayed in its employment to initiate the removal of a respective stack to permit completion of the feeding of that stack.

* * * * *

UNITED STATES PATENT AND TRADEMARK OFFICE

CERTIFICATE OF CORRECTION

PATENT NO. : 4,046,259

DATED : September 6, 1977

INVENTOR(S) : CLIFFORD E. DUNLAP

It is certified that error appears in the above-identified patent and that said Letters Patent are hereby corrected as shown below:

| | | | | |
|---|---|---|---|---|
| Column | 1, | Line | 66, | cancel "able" and insert --- ably marked ---; |
| Column | 2, | Line | 42, | cancel "programming" and insert --- programmer ---; |
| Column | 2, | Line | 54, | cancel "nip" and insert --- zip ---; |
| Column | 5, | Line | 16, | cancel "isa" and insert --- is a ---; |
| Column | 12, | Line | 33, | cancel "lie" and insert --- live ---; |
| Column | 14, | Line | 37, | cancel "shfit" and insert --- shift ---; |
| Column | 14, | Line | 58, | before "preferred" cancel "Th" and insert --- The ---; |
| Column | 21, | Line | 58, | cancel "interface" and insert --- interfere ---; |
| Column | 22, | Line | 13, | after "96" cancel "and" and insert --- or ---; |
| Column | 23, | Line | 27, | cancel "threby" and insert --- thereby ---; |

UNITED STATES PATENT AND TRADEMARK OFFICE

CERTIFICATE OF CORRECTION

PATENT NO. : 4,046,259

DATED : September 6, 1977

INVENTOR(S) : CLIFFORD E. DUNLAP

It is certified that error appears in the above-identified patent and that said Letters Patent are hereby corrected as shown below:

| | | | | |
|---|---|---|---|---|
| Column | 23, | Line | 36, | cancel "wil" and insert --- will ---; |
| Column | 23, | Line | 62, | (at the end of the line) after "its" insert --- up ---; |
| Column | 24, | Line | 19, | (at the end of the line) after "Model" cancel "b"; |

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*